US010890372B2

(12) United States Patent
Hanning

(10) Patent No.: US 10,890,372 B2
(45) Date of Patent: Jan. 12, 2021

(54) REFRIGERATED OVEN AND SYSTEM FOR COOKING FOOD ITEMS

(71) Applicant: Jeffrey L. Hanning, Clovis, CA (US)

(72) Inventor: Jeffrey L. Hanning, Clovis, CA (US)

( * ) Notice: Subject to any disclaimer, the term of this patent is extended or adjusted under 35 U.S.C. 154(b) by 82 days.

(21) Appl. No.: 16/377,232

(22) Filed: Apr. 7, 2019

(65) Prior Publication Data

US 2020/0318890 A1 Oct. 8, 2020

(51) Int. Cl.

| | |
|---|---|
| ***F25D 23/12*** | (2006.01) |
| ***F24C 7/08*** | (2006.01) |
| ***F24C 15/16*** | (2006.01) |
| ***F24C 15/02*** | (2006.01) |

(52) U.S. Cl.

CPC ..... *F25D 23/12* (2013.01); *F24C 7/085* (2013.01); *F24C 15/02* (2013.01); *F24C 15/16* (2013.01); *F25D 2325/00* (2013.01); *F25D 2400/02* (2013.01)

(58) Field of Classification Search

CPC .. F25D 23/12; F25D 2325/00; F25D 2400/02; F24C 7/085; F24C 15/02; F24C 15/16

USPC ..... 99/357, 352, 451; 219/470, 472, 686, 219/702, 703, 704, 720, 401

See application file for complete search history.

(56) References Cited

U.S. PATENT DOCUMENTS 3,682,643 A * 8/1972 Foster ..... A23B 4/01 426/233
4,294,081 A * 10/1981 Mitani ..... F25B 5/04 62/140
4,355,521 A * 10/1982 Tsai ..... F25B 29/003 165/288
4,782,214 A * 11/1988 Voegtlin ..... A21B 3/04 219/401
4,791,861 A * 12/1988 Weinkle ..... A21B 1/00 126/19 R
5,228,499 A * 7/1993 Yoon ..... F25D 17/065 165/263
5,388,427 A * 2/1995 Lee ..... F25D 17/065 165/63
5,398,599 A * 3/1995 Woo ..... A23B 7/10 165/263
5,458,186 A * 10/1995 Lee ..... F25D 17/065 165/263
5,521,359 A * 5/1996 Bone ..... H05B 6/68 219/679

(Continued)

*Primary Examiner* — Jimmy Chou
(74) *Attorney, Agent, or Firm* — Richard A. Ryan

(57) ABSTRACT

A refrigerated oven and system for cooking food items to be ready to eat at a desired time. The oven has a cooking compartment attached to or integral with a refrigerator unit. An interior chamber of the cooking compartment is in fluid flow communication with the refrigerator unit and configured to receive a food item therein. The food item can be kept refrigerated until cooked. Air flow doors allow or prevent cold air from the refrigerator unit flowing into the interior chamber and hot air from the cooking compartment flowing into the refrigerator unit. A control device opens and closes the doors to cool or cook the food item, start the cooking process at the desired temperature and stop cooking at the desired time. The control device is remotely accessed by a smart phone or other electronic device. The cooking compartments can be removably connected to the refrigerator unit.

20 Claims, 10 Drawing Sheets

(56) References Cited

U.S. PATENT DOCUMENTS 5,546,759 A * 8/1996 Lee ..... F25D 17/065 62/441
5,696,872 A * 12/1997 Seward ..... F24C 15/322 392/341
5,941,085 A * 8/1999 Jeon ..... F25D 21/12 62/151
6,073,547 A * 6/2000 Westbrooks, Jr. .... A47J 39/003 165/48.1
6,278,098 B1 * 8/2001 Han ..... F25D 23/12 126/21 A
6,497,276 B2 * 12/2002 Clark ..... F25D 23/12 126/21 A
7,721,797 B2 * 5/2010 Godecker ..... F25D 23/12 165/253
9,664,436 B1 * 5/2017 Hall ..... F25D 23/12
2002/0170303 A1 * 11/2002 Clark ..... F25D 23/12 62/206
2003/0070789 A1 * 4/2003 Mueller ..... F25D 19/00 165/61
2003/0070799 A1 * 4/2003 Mueller ..... F25D 31/005 165/254
2005/0103466 A1 * 5/2005 Landry ..... F25D 23/12 165/61
2007/0158335 A1 * 7/2007 Mansbery ..... F24C 7/082 219/505
2007/0163291 A1 * 7/2007 Kim ..... F25D 17/08 62/408
2008/0087663 A1 * 4/2008 Mansbery ..... G05B 19/0426 219/679
2008/0302253 A1 * 12/2008 Salvaro ..... F24C 15/00 99/325
2009/0084778 A1 * 4/2009 Smario ..... F25D 23/12 219/679
2009/0188911 A1 * 7/2009 Emma ..... F25D 23/12 219/679
2009/0193826 A1 * 8/2009 Yasugi ..... F25D 11/02 62/159
2010/0139300 A1 * 6/2010 Jeong ..... F25D 21/08 62/186
2010/0200555 A1 * 8/2010 Godecker ..... F25B 21/02 219/201
2014/0251982 A1 * 9/2014 Emma ..... F25B 29/00 219/679
2015/0204601 A1 * 7/2015 Baker ..... F24F 5/0021 62/440

* cited by examiner

REFRIGERATED OVEN AND SYSTEM FOR COOKING FOOD ITEMS

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to apparatuses and systems that are utilized for easily, efficiently and effectively cooling and cooking food. In particular, the present invention relates to such apparatuses and systems that are specially adapted to receive and safely store food, including refrigerated items, and then cook the food at the required temperature and for the required amount of time so the food will be ready to eat at a pre-set time of day. Even more particularly, the present invention relates to such apparatuses and systems that can have multiple compartments which are each configured to properly store and cook food and allow the user to select whether the food in the individual compartments is refrigerated or not and how and when the food is cooked.

B. Background

There are many different types of apparatuses and systems for storing and cooking food, including a wide range of differently configured non-refrigerated pantries, refrigerators, freezers and ovens. Non-refrigerated pantries typically store food at room temperature, whereas refrigerators are configured to store food at a significantly cool, but not freezing, temperature and freezers are configured to store food in a frozen condition. In one configuration, refrigerators store food at or near 40° F. and freezers store food below the freezing point of water (i.e., 32° F.). Food which is intended to be refrigerated or frozen will usually spoil and become inedible, often in a relatively short period of time, if the food is not properly stored in an appropriately configured refrigerator or freezer. With regard to food that will be cooked in an oven, some of the food is moved directly from the non-refrigerated pantry, refrigerator or freezer to the oven, which is configured to cook the food at a temperature, often above 350° F., and for a time that is controlled by the user. In certain circumstances, frozen food will be defrosted prior to being cooked. The temperature and time for the oven are selected by the user to cook the food in the manner which will produce the desired final, edible cooked food item.

Some food items can be easily and quickly prepared and moved from the pantry, refrigerator or freezer to the oven where the food item will be cooked for the desired or required temperature and time. As well known, however, many food items, if not most food items, require time and effort to prepare the food item prior to cooking, including such activities as obtaining the necessary ingredients that will make up the food item and to clean, measure, cut, mix and/or otherwise modify or combine the ingredients of the food item. For some home-prepared food items, the preparation time and effort can be somewhat significant, often eclipsing the amount of time it takes to cook the food item. As also well known, in addition to the time and effort needed to gather and prepare a food item for cooking, many food items require a significant amount of time to clean the food preparation area and the materials that were utilized to prepare the food item, including pots, pans, knives, spoons and the like. In general, most people will appreciate that many of the best tasting and healthiest home-prepared food items, which are often the most desired food items, require more time to prepare for cooking and to clean up after than less quality and less healthy food items. In addition to the foregoing, many of the best tasting and healthiest home-prepared food items also tend to have higher cost ingredients, particularly with regard to "natural" ingredients.

One manner of balancing the desire to have a quality prepared food item and the time it takes for a person to prepare the food item is for him or her to prepare the food item in advance and place the food item in the refrigerator or freezer for cooking and consumption at a later time or different day. This requires the person to select food items that can be prepared in advance, get and prepare the ingredients to create the prepared food item in advance and then cook the food item when ready to have it for a meal. Although advance preparation of a food item can remove some of the issues associated with fixing a healthy meal at the last minute, many people do not desire to have their "free time", which is usually the weekends and/or evenings, monopolized by preparing meals in advance, at least not on a regular basis.

In light of all of the issues related to preparing, cooking and cleaning up home-prepared food items, many people tend not to spend the time, effort and cost to prepare their own food items. Instead of preparing, cooking and eating a quality home-cooked meal, many people end up having fast-food take out or simple to prepare and cook frozen or otherwise preserved food items (including food items such as frozen pizza, frozen lasagna, frozen chicken and the like) in order to avoid the issues with preparing their own food items. Many of these food items are suitable for cooking in a microwave oven or the like to reduce the cooking time. In addition, the modern lifestyle of most people limits the amount of time they have available to prepare and cook a meal and cleanup thereafter. Besides the fact that most homes have the parent or both parents working until close to dinner time, the various activities the family members are engaged in, which can include stops at the gym, after school sports, plays and other activities and the like, make it very difficult for most persons to have time to prepare quality food items and then to be able to cook the food item in a time frame so he or she, and/or his or her family, can eat the food item at a reasonable time of day. This lack of desire and/or time to prepare quality home-prepared food items often results in the person and/or his or her family eating much more fast food and/or low quality foods than most people would otherwise choose to do, which is generally considered not conducive to eating healthy and engaging in a healthy lifestyle.

Most people readily understand and appreciate that their health and longevity is significantly impacted by the foods they choose to eat or end up eating. In response to the desire to have easily prepared, healthy alternatives to fast food and easily prepared frozen or preserved food, various companies have begun offering food items that have been previously prepared, healthy to eat and be easy to cook and cleanup after eating. Some of these alternative meal preparation services offer food items that are completely prepared and ready to be placed into the oven to cook and then eat. Other services may require or encourage a person to add one or more fresh ingredients to the previously prepared food item prior to and/or during the cooking process. In either configuration, these services generally utilize much healthier ingredients and are prepared in a manner which results in a healthier food item and, therefor, are often desired by persons who have limited amount of time to prepare such food items. The typical service will deliver the prepared food item to the person's home, where the food item is placed into the refrigerator or freezer, as may be applicable, until it is time to prepare the meal, at which time he or she takes the food item out of the refrigerator or freezer and places into the oven for cooking.

In any of the above scenarios where the person responsible for preparing and/or cooking a meal has a busy schedule and, as a result, limited time to prepare and cook the meal, there is still an issue of being able to have the meal ready to eat at a reasonable time of day (i.e., not late in the evening). As will be readily appreciated by persons who are responsible for preparing and cooking meals, a major issue is being able to start cooking the food item in the oven so the meal will be ready to eat before it is late in the day. Unfortunately, many food items require a somewhat significant amount of time to cook. In addition to the actual cooking time for the food item, the oven must go through a preheat phase to arrive at the desired temperature at which the food item will be cooked and then, as is applicable, cool down for eating. This requires the food preparer to plan sufficiently in advance that the food item will be cooked and ready to eat by the desired meal time. However, as will also be readily appreciated by food preparers, this is very difficult in the circumstance where a person does not get home from work or other activities until about the time he or she would otherwise desire to eat and to feed his or her family. Without having a person who is home to begin the preparing and cooking process early enough to have the food item cooked by the desired eating time, the person either has to eat later in the day or eat "fast food" or other meals which can be quickly cooked, often without consideration to the healthful quality of the food item(s) that makeup the meal.

What is needed, therefore, is an improved apparatus and system for cooking food items that allows a person to better schedule the time of day when the food item will be cooked and ready to eat. More specifically, what is needed is an apparatus and system that are configured to allow the user to store a previously prepared food item, no matter the source of the food item or how it was prepared, and then cook the food item so it will be ready to eat at a desired time of day. The apparatus should be structured and arranged so as to properly store a previously prepared food item in a manner which will maintain the safety and quality of the food item until it is ready to be cooked and then cook the food item at a desired temperature and for a desired amount of time so that the food item will be ready to eat at the person's preset desired eating time. As such, the new apparatus should be able to keep, as may be applicable, refrigerated food items properly refrigerated and frozen food items fully frozen until such time as it is necessary to begin the heating process to cook the food item. The new apparatus and system should be configured to properly store and cook a plurality of food items that each require different storage requirements, namely room temperature, refrigerated or frozen, and/or different temperature and duration cooking requirements. Preferably, the new apparatus and system should be adaptable for use with a wide variety of different types of food items and food item storage and cooking requirements. In a preferred configuration, the new apparatus should be relatively inexpensive to manufacture so that the apparatus and system can be widely utilized.

SUMMARY OF THE INVENTION

The following presents a simplified summary of the disclosure in order to provide a basic understanding to the reader. As such, this Summary is not an extensive overview of the disclosure and it does not identify key/critical elements of the invention or delineate the scope of the invention. The sole purpose of this Summary is to present some concepts disclosed herein in a simplified form as a prelude to the more detailed description that is presented later.

The new apparatus and system of the present invention provides the benefits and solves the problems that are identified above. That is to say, the present invention describes a new refrigerated oven and system having the new refrigerated oven that can be beneficially utilized to store and cook food items in a manner which has the food item ready to eat at a time of day desired by the users thereof. More specifically, the new refrigerated oven and system of the present invention is structured and arranged to allow the user thereof to place food items in the refrigerated oven, properly refrigerate, freeze or otherwise store the food item therein until it is time to cook the food item and then cook the food item at the desired temperature and duration so the food item will be ready to eat at a desired time of day (the user's desired eating time). As such, the new refrigerated oven and system will maintain the safety and quality of the food item by keeping, as may be applicable, refrigerated food items properly refrigerated and frozen food items fully frozen until such time as it is necessary for the refrigerated oven to begin the heating process to cook the food item for consumption at the user's desired eating time. In a preferred configuration, the new refrigerated oven and system has multiple, separately operated storing and cooking compartments that are each configured to properly store and cook a food item in a manner which is proper for that food item. The refrigerated oven and system will store the food item at room temperature or by keeping it refrigerated or frozen, as may be applicable, and then cook the food item at the cooking temperature and duration which is applicable for that food item, taking into account the necessary preheating, cooking and cooling times, so all of the food items will be ready to eat at the user's desired eating time or time(s). In a preferred configuration, the new refrigerated oven and system are connected to the internet or other communication network so that the user can remotely access and operate the refrigerated oven to reset, start, pause and/or stop the cooking process using a smart phone, tablet, laptop or other computer enabled electronic device. In the preferred configurations, the refrigerated oven and system are readily adaptable for use with a wide variety of different types of food items and food item storage and cooking requirements and the refrigerated oven is relatively inexpensive to manufacture so that the refrigerated oven and system utilizing the new refrigerated oven can be widely utilized.

In one embodiment of the present invention, the new refrigerated oven for cooking a food item generally comprises a housing having a plurality of walls, a refrigerator unit disposed in the housing, one or more cooking compartments attached to or integral with the refrigerator unit, a compartment door movably associated with each of the one or more cooking compartments, an air flow door disposed between the refrigerator unit and the cooking compartment or associated with one of the refrigerator unit and the cooking compartment, and a control device operatively connected to the air flow door and cooking compartment. The refrigerator unit has a refrigeration mechanism that is structured and arranged to discharge cold air from the refrigerator unit. Each of the cooking compartments have an interior chamber that is sized and configured to removably receive the food item therein and a cooking mechanism which is structured and arranged to discharge hot air into the interior chamber to cook the food item when the food item is positioned inside the interior chamber. The interior chamber of the cooking compartments are in fluid flow communication with the refrigerator unit to receive cold air from the refrigeration mechanism to keep the food item in the interior chamber cold until it is cooked. The compartment door is configured to move between an open position to allow a user to place the food item in or to remove the food item from the interior compartment and a closed position to enclose the food item in the interior chamber for keeping the food item cool or to cook the food item. The air flow door is utilized to prevent air flow between the refrigerator unit and the interior compartment when the air flow door is in a closed position and to allow air flow between the refrigerator unit and the interior compartment when the air flow door is in an open position, which will allow cold air into the interior chamber to keep any food item therein cool.

The user interfaces with the control device so he or she can select which cooking compartment(s) will be in use, select whether the food item in the interior chamber is to be refrigerated or left unrefrigerated and to enter cooking instructions that sets when the cooking mechanism starts cooking the food item, how long the food item is cooked and the temperature at which the food item is cooked. The control device is operatively connected to the air flow door to place the air flow door in the closed position or the open position to control the flow of cold air from the refrigeration mechanism of the refrigerator unit into the interior chamber. The control device is operatively connected to the cooking mechanism of the cooking compartment to control, according to the cooking instructions, the flow of hot air from the cooking mechanism into the interior chamber. In use, the food item will be kept cold when it is positioned in the interior chamber with the air flow door in its open position, which allows cold air to flow into the interior chamber, and is cooked by the cooking mechanism with the air flow door being in its closed position, which prevents cold air flowing into the interior chamber and hot air flowing into the refrigerator unit. In a preferred embodiment, the control device has a communication device that is structured and arranged to remotely connect to an electronic device across a communication network to allow the user to access, review, and edit the cooking instructions to change the time when the food item will be done, pause the cooking process and/or terminate the cooking process as the user's circumstances change. Preferably, prior to starting the cooking process, the refrigerated oven will utilize the connection to the internet, via the communication device, and the user's electronic device to send the user a reminder that cooking is about to begin and inquire of the user of whether or not he or she would like to keep the current schedule or make one or more changes to the cooking process. This will allow the user to confirm the schedule or move up or push back the eating time and/or one or more other settings. If the eating time is pushed back, even to a later date, the refrigerator oven will keep the food item at the recommended and safe temperature until the food item is cooked.

In one embodiment of the present invention, the refrigerated oven is formed as a single, unified unit. In another embodiments, at least one of cooking compartments is a removable cooking compartment that is removably associated with the housing and removably connected to the refrigerator unit. Each removable cooking compartment is removably received in a passageway that is defined by the housing between the refrigerator unit and a passageway opening that is locate at one of the walls of the housing, such as the front wall, when the removable cooking compartment is connected to the refrigerator unit. Typically, a barrier like door will be movably associated with the housing at or near the passageway opening to selectively close the passageway to prevent cold air from exiting the housing when the removable cooking compartment is not in the passageway (i.e., when the passageway is open). In one configuration, the barrier is pivotally attached to the housing and configured to swing upward when the user presses the removable cooking compartment against the barrier. In one embodiment of the refrigerated oven, all of the cooking compartments are removable cooking compartments and the housing defines a plurality of passageways that are each sized and configured to removably receive one of the removable cooking compartments in order to allow the user to cool and cook a plurality of the food items (i.e., one food item in each cooking compartment) with the new refrigerated oven.

A system for storing and cooking food items generally comprises the refrigerated oven described above, a food item to be cooked in the refrigerated oven and a user associated with the food item. In certain embodiments of the system, one or more of the cooking compartments is removably connected to the refrigerator unit. In a preferred embodiment, the new system has an electronic device, such as a smart phone, tablet or the like, that is associated with the user, and a communication network, such as the internet, to which the electronic device is connected. In this embodiment, the control device of the refrigerated oven has a communication device operatively connected to the control device to connect the refrigerated oven to the communication network to allow the user to remotely connect to the refrigerated oven and access the cooking instructions using the electronic device with the communication network.

Accordingly, the primary object of the present invention is to provide a new refrigerated oven and system for cooking food items that has the advantages set forth above and which overcomes the disadvantages and limitations which are associated with presently available apparatuses and systems for cooking food items that have been prepared in advance.

It is an important object of the present invention to provide a new refrigerated oven and system that are structured and arranged to properly store a food item until such time as the food item will need to be cooked and then to cook the food item at the proper temperature and duration so the food item will be ready to eat at the user's desired eating time.

It is also an important object of the present invention to provide a new refrigerated oven and system that has a plurality of separate compartments which are each, individually, structured and arranged to properly store and cook a food item, as may be applicable for that food item, so that each of the food items will be ready to eat at the user's desired eating time.

An important aspect of the present invention is that it provides a new refrigerated oven and system which accomplishes the objectives set forth above and elsewhere in the present disclosure.

Another important aspect of the present invention is that it provides a new refrigerated oven and system which are structured and arranged to allow the user to easily, efficiently and properly store and cook one or more food items in a manner which will result in the food item(s) being ready to eat at the user's preset eating time.

Another important aspect of the present invention is that it provides a new refrigerated oven and system which are structured and arranged to separately store and cook multiple food items by receiving and storing each food item in its proper condition, whether non-refrigerated, refrigerated or frozen, and then cooking each food item according at its proper temperature and for the necessary duration so as to have each of the food items be done cooking and ready to eat at the user's desired eating time.

Another important aspect of the present invention is that it provides a new refrigerated oven and system which are structured and arranged to store and cook a food item at room temperature or by keeping the food item refrigerated or frozen, as may be applicable or desired, and then cook the food item at the proper cooking temperature and duration, as may be applicable for that food item, taking into account the necessary preheating, cooking and cooling times so the food item will be ready to eat at the user's desired eating time.

Another important aspect of the present invention is that it provides a new refrigerated oven and system which, in one embodiment, are connected to the internet or other communication network so that the user can remotely access and operate the refrigerated oven, with a food item therein, to reset, start, pause and/or stop the cooking process using a smart phone, tablet, laptop or other computer enabled electronic device.

Another important aspect of the present invention is that it provides a new refrigerated oven and system which will send the user's electronic device a reminder, via the internet or other communication network, that cooking of the food item is about to begin and inquire of the user of whether or not he or she would like to keep the current schedule or make one or more changes to the cooking process, thereby allowing the user to confirm the schedule or move up or push back the eating time and/or one or more other settings.

Another important aspect of the present invention is that it provides a new refrigerated oven and system which will keep a food item at the recommended and safe temperature until the food item is cooked, even if the eating time has been pushed back to a later date.

Another important aspect of the present invention is that it provides a new refrigerated oven and system which are readily adaptable for use with a wide variety of different types and combinations of food items that may have a variety of food item storage and cooking requirements.

Another important aspect of the present invention is that it provides a new refrigerated oven and system which are easy to use and effective at storing and cooking one or more food items in a manner which allows the user to have a meal, comprising one or more food items, ready to eat at his or her desired eating time.

Yet another important aspect of the present invention is that it provides a new refrigerated oven which is relatively inexpensive to manufacture so the refrigerated oven and system utilizing the new refrigerated oven can be widely utilized.

As will be explained in greater detail by reference to the attached figures and the description of the preferred embodiments which follow, the above and other objects and aspects are accomplished or provided by the present invention. As set forth herein and will be readily appreciated by persons who are skilled in the art, the present invention resides in the novel features of form, construction, mode of operation and combination of processes presently described and understood by the claims. The description of the invention which follows is presented for purposes of illustrating one or more of the preferred embodiments of the present invention and, as such, is not intended to be exhaustive or limiting of the invention. The scope of the invention is only limited by the claims which follow after the discussion of the preferred embodiments.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
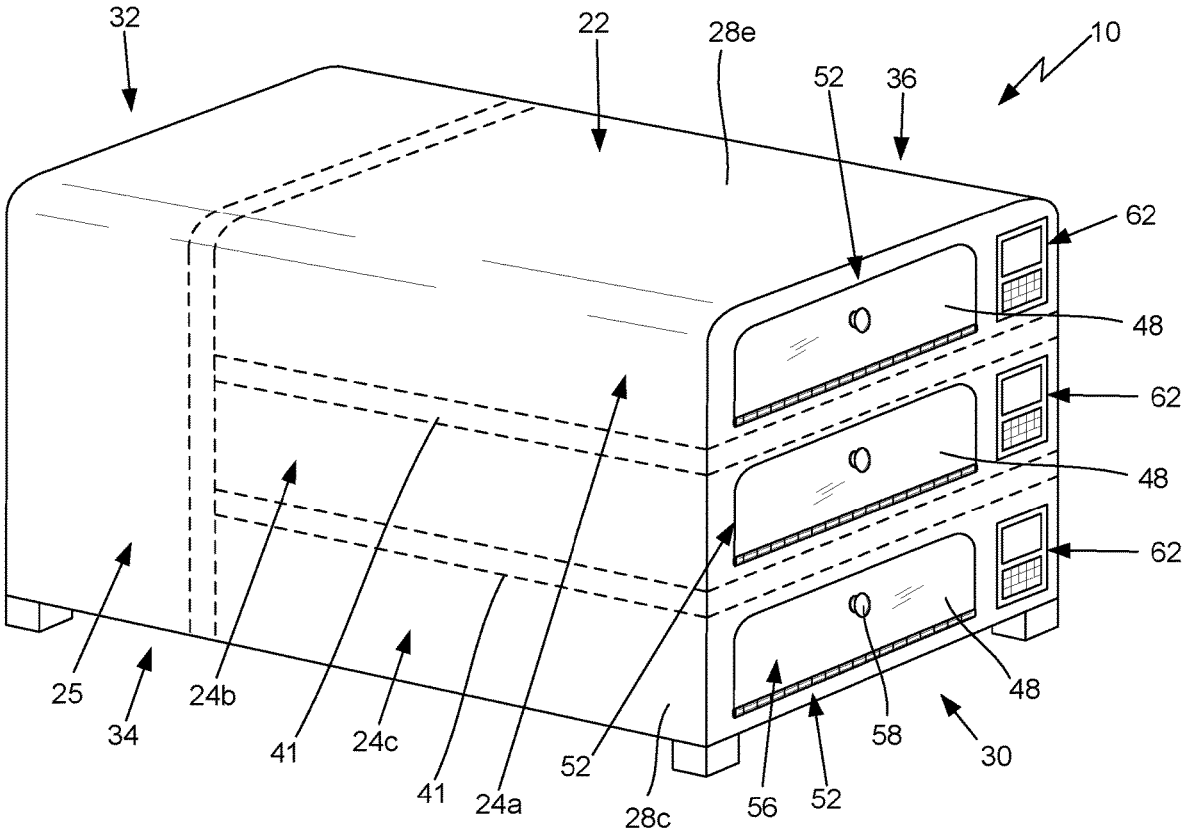
FIG. 1 is a side perspective view of a refrigerated oven that is configured according to a first embodiment of the present invention showing use of three cooking compartments attached to a refrigerator unit, with each of the compartment doors shown in their closed position.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the refrigerated oven of the present invention, as well as examples of food items with which the new refrigerated oven may be utilized, persons who are skilled in the relevant art will readily appreciate that the present invention is not so limited. In addition, the exemplary embodiments of the present invention are shown and described herein with only those components that are required to disclose the present invention. As such, it may be possible that some of the necessary elements for attaching and using the present invention are not shown or necessarily described below, but which are well known to persons who are skilled in the relevant art. As will be readily appreciated by such persons, the various elements of the present invention that are described below may take on any form which is consistent with forms that may be understood by a person of ordinary skill in the art having knowledge of refrigeration and cooking components that are or can be utilized with food items.

The use of "including", "comprising" or "having" and variations thereof herein is meant to encompass the items listed thereafter and equivalents thereof as well as additional items. The terms "a" and "an" utilized herein do not denote a limitation of quantity, but rather denote the presence of at least one of the referenced item. Further, the use of terms "first", "second", and "third", and the like, herein do not denote any order, quantity, or importance, but rather are used to distinguish one element from another.

A refrigerated oven that is configured pursuant to one or more of the preferred embodiments of the present invention is referred to generally as 10 in FIGS. 1-3, 6-10 and 14-15. A system that is configured pursuant to one or more of the preferred embodiments of the present invention and which has as one of its components the new refrigerated oven 10 is referred to generally as 12 in FIGS. 10 and 11. As set forth in more detail below, the new refrigerated oven 10 of the present invention is structured and arranged to receive, store and cook one or more food items 14, shown in FIGS. 6-11, in a manner which allows the user 16 of the refrigerated oven 10 and system 12 have the food items 14 cooked and ready to eat at his or her desired eating time 18. As set forth in the Background, one of the major issues pertaining to preparation of a meal 20, which includes one or more food items 14, is the timing issue related to starting the cooking process early enough in the day so the food items 14 will be thoroughly and properly cooked and ready to eat at a time of day which is not too late. As well known, by the time a person gets off work and/or finishes any other activities, including time at a gym, after school activities and the like, there is little time to prepare and then start the cooking process to have the meal 20 by the desired eating time 18. The present invention will make it significantly easier for the user 16 thereof to take advantage of previously prepared, healthy food items 14, whether prepared by the user 16 or by other persons, and plan and cook a meal 20 without having to rely on fast food or less healthy and/or poorly prepared foods due to the need to have the meal 20 ready to eat by the desired eating time 18. In addition, the completion time for the meal 20, namely the eating time 18, may be altered by the use 16 throughout the day as needed or desired.

With regard to the present invention, the food item 14 can be a wide variety of different types of food products having a wide variety of different types and quantities of ingredients and a meal 20 can include just one food item 14, multiple food items 14 and/or other food products that are not considered food items 14 for the present invention, such as fresh fruit, salad and the like, that do not have need to be cooked. For instance, a food item 14 can comprise a single ingredient, such as tomato soup and the like, or it can comprise a combination of ingredients that are purposefully combined to produce the food item 14, such as lasagna, stew, pizza or the like. When the present refrigerated oven 10 and system 12 are utilized to cook multiple food items 14, the food items 14 can be eaten together as the meal 20 for an entire family or one or more of the food items 14 can be a meal 20 onto itself, such as a food item 14 cooked for only one family member to eat because he or she does not like the other food item(s) 14. As will be readily appreciated by persons who are skilled in the relevant art, there are no limitations, as long as it is capable of being cooked (as opposed to boiled or fried, for instance), with regard to the type of food items 14 which can be utilized with the new refrigerated oven 10 and system 12 of the present invention. In addition, in a living arrangement where multiple tenants (i.e., multiple users 16) share a kitchen having multiple refrigerated ovens 10, each refrigerated oven 10 can be assigned to a different user 16 in a manner which allows him or her (and only him or her) to have access to the user's specific refrigerated oven 10.

Though not necessarily required for use of the refrigerated oven 10 and system 12 of the present invention, typically the food item 14 will be in an appropriately configured cooking container 21 when the food item 14 is placed in and cooked inside the refrigerated oven 10, as shown with regard to FIGS. 6-10. As well known, the cooking container 21, if utilized, can be an aluminum tray, a ceramic dish, a glass container or the like in which the food item 14 is located after the ingredients which make up the food item 14 are cleaned, cut, sliced, chopped or otherwise prepared. In some circumstances, the cooking container 21 will be of the type that is disposable, as is common for aluminum trays and the like. In other circumstances, the cooking container 21 will be of the type which is suitable for serving the food item 14 to those who will consume the food item 14 after the food item 14 has been cooked in the refrigerated oven 10.

The new refrigerated oven 10 and system 12 of the present invention generally comprises a housing 22 and at least one cooking compartment 24, at least one refrigerator unit 25 and one or more air flow doors 26 that are operatively associated with the cooking compartments 24 and the refrigerator unit 25, as best shown in FIGS. 1-10 and 12-13, to allow refrigerated air, as may be required or desired, to flow from the refrigerator unit 25 to the cooking compartments 24. Each cooking compartment 24 has a refrigerator unit 25 associated therewith and each refrigerator unit 25 has at least one cooking compartment 24 associated therewith, as best shown in FIGS. 1, 3 and 6-10. In the embodiments shown in the figures, the refrigerated oven 10 has three cooking compartments, shown as first cooking compartment 24*a*, second cooking compartment 24*b* and third cooking compartment 24*c*, that are attached to or integral with a single refrigerator unit 25, as best shown in FIGS. 1-3 and 6-10. In a typical use of the refrigerated oven 10 of the present invention, each cooking compartment will store and cook a single food item 14 so the food item 14 can be cooled and cooked in a manner which is appropriate for that food item 14. If more than one food item 14 have the same cooling and cooking requirements and the food items 14 will fit inside a single cooking compartment 24, then it may be possible for the user 16 to store and cook more than one food item 14 inside a cooking compartment 24 at a time.

Figure 2:
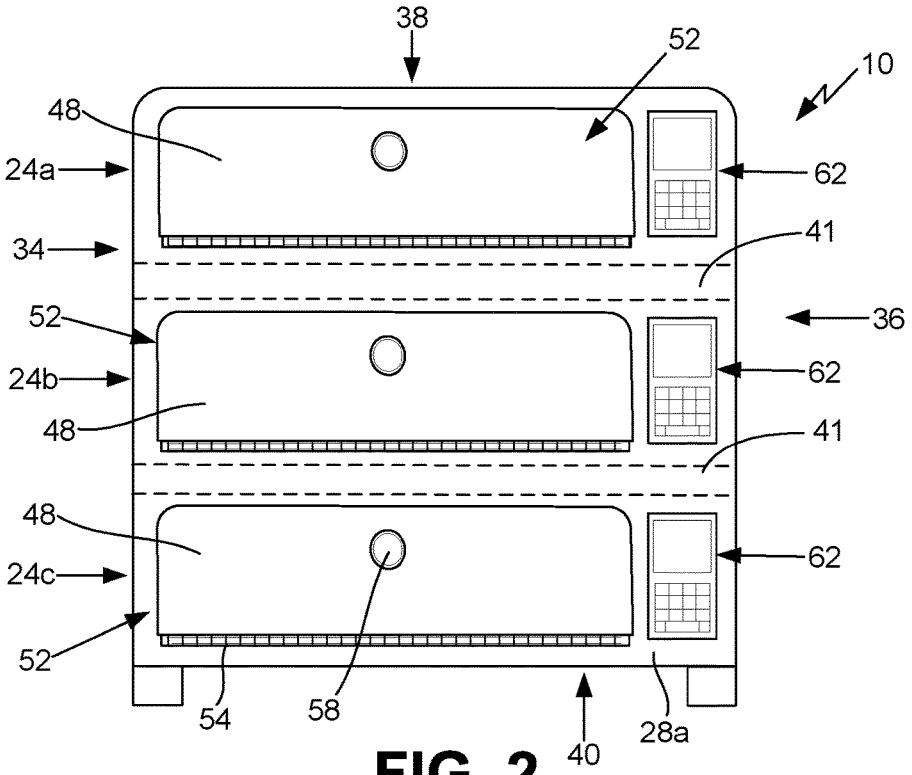
FIG. 2 is a front view of the refrigerated oven of FIG. 1.
Figure 3:
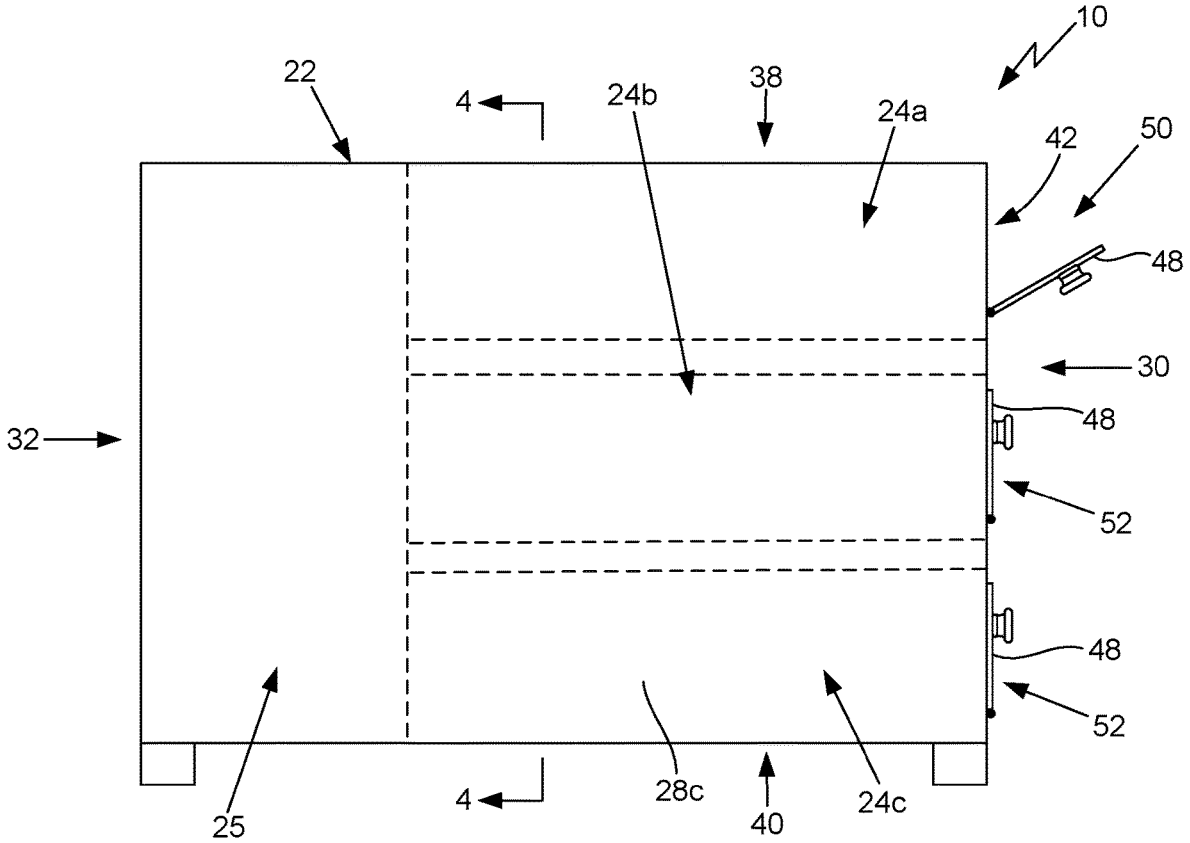
FIG. 3 is a left side view of the refrigerated oven of FIG. 2, with the compartment door of the first cooking compartment shown in an open position and the compartment doors of the second and third cooking compartments shown in a closed position.
Figure 4:
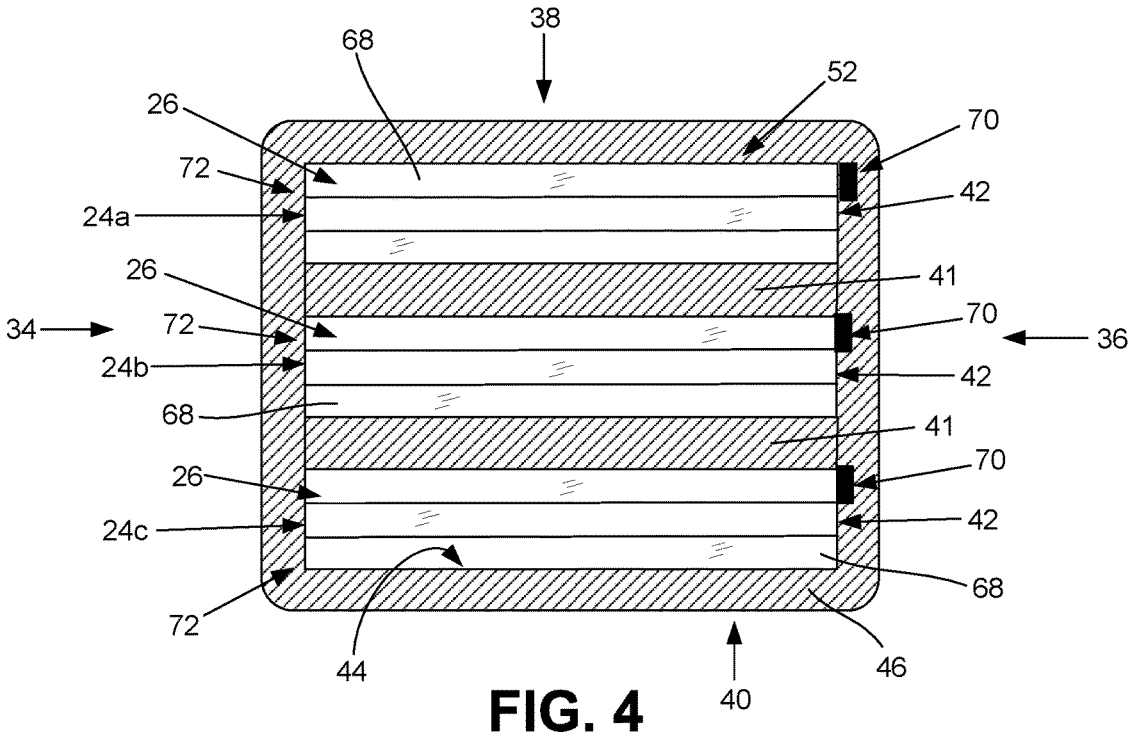
FIG. 4 is a cross-sectional front view of the refrigerated oven of FIG. 1 taken through lines 4-4 of FIG. 3 to illustrate insulated walls thereof and the air flow doors that connect the refrigerator unit to each of the cooking compartments, with each set of the air flow doors shown in their closed position.
Figure 5:
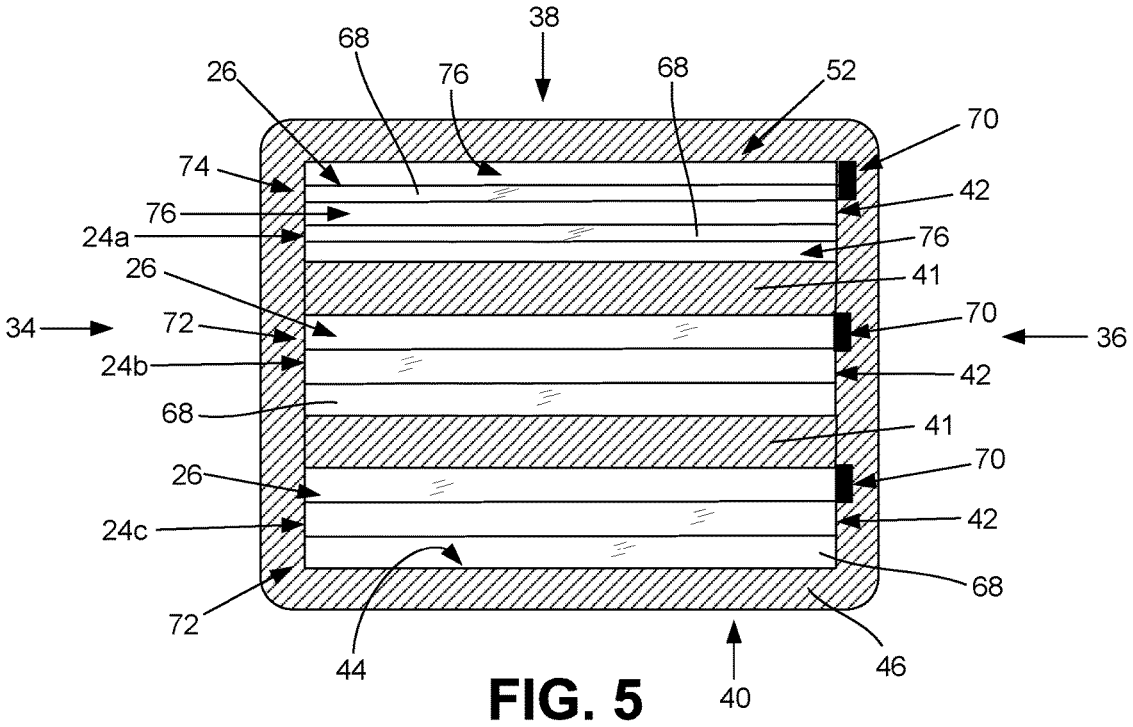
FIG. 5 is a cross-sectional front view of the refrigerated oven of FIG. 4 with the air flow door of the first cooking compartment shown in its open position.

The housing 22 has one or more insulated walls 28 that define a front end 30, back end 32, first or left side 34, second or right side 36, top side 38 and bottom side 40 of the refrigerated oven 10, as best shown in FIGS. 1-3 for a refrigerated oven 10 having multiple cooking compartments 24. In the embodiments of the refrigerated oven 10 shown in the figures, the housing 22 is generally rectangular shaped having a front wall 28*a*, back wall 28*b*, first/left wall 28*c*, second/left wall 28*d*, top wall 28*e* and bottom wall 28*f*. As will be readily appreciated by persons skilled in the art, the housing 22 can be of nearly any size and shape. When having multiple cooking compartments 24, there will typically be a divider wall 41 that separates a cooking compartment 24 from an adjacent cooking compartment 24. The one or more walls 28 and, as applicable, the divider wall 41 separating cooking compartments 24 define an interior chamber 42 of the cooking compartment 24 in which the food item 14 is inserted, cooled (as may be necessary) and heated. The interior chamber 42 has an item surface 44, as best shown in FIGS. 1 and 4-5, on which the food item 14 is placed by the user 16 and on which the food item 14 rests while it is inside the interior chamber 42. Typically, the upper surface of the divider walls 41 will form the item surface 44 of the above positioned interior chamber 42. As set forth in more detail below, because the interior chamber 42 will be cooled and/or heated, it is necessary that all of the walls 28 and the divider walls 41 of the cooking compartment 24 are properly insulated to avoid wasted energy resulting from the undesirable loss of cooling or heating through the walls 28, uncomfortable contact by the user 16 and/or others against the outer surfaces of the walls 28, potentially harmful transfer of heat through the bottom wall 28*f* onto a counter, cabinet or other support surface on which or in which the refrigerated oven 10 is located and/or the transfer of cooling or heating between adjacent cooking compartments 24 in a refrigerated oven 10 having multiple cooking compartments 24. To provide the necessary insulation, the cooking compartment 24 has an insulating material 46 between the exterior and interior surfaces of the walls 28 and divider walls 41 or otherwise associated with the walls 28 (i.e., forming an interior or exterior surface) and divider walls 41. As well known in the art, the insulating material 46 can be a wide variety of different types of materials, including solids (as shown in FIG. 4-5), air or other gas, liquid or the like materials that are able to effectively insulate the walls 28 and divider walls 41 of the refrigerated oven 10 of the present invention based on the temperatures anticipated to be inside the interior chamber 42. In one configuration of the present invention, the interior chamber 42 will experience a temperature range of below freezing (i.e., 32° F.) to 450° F. or higher.

Figure 15:
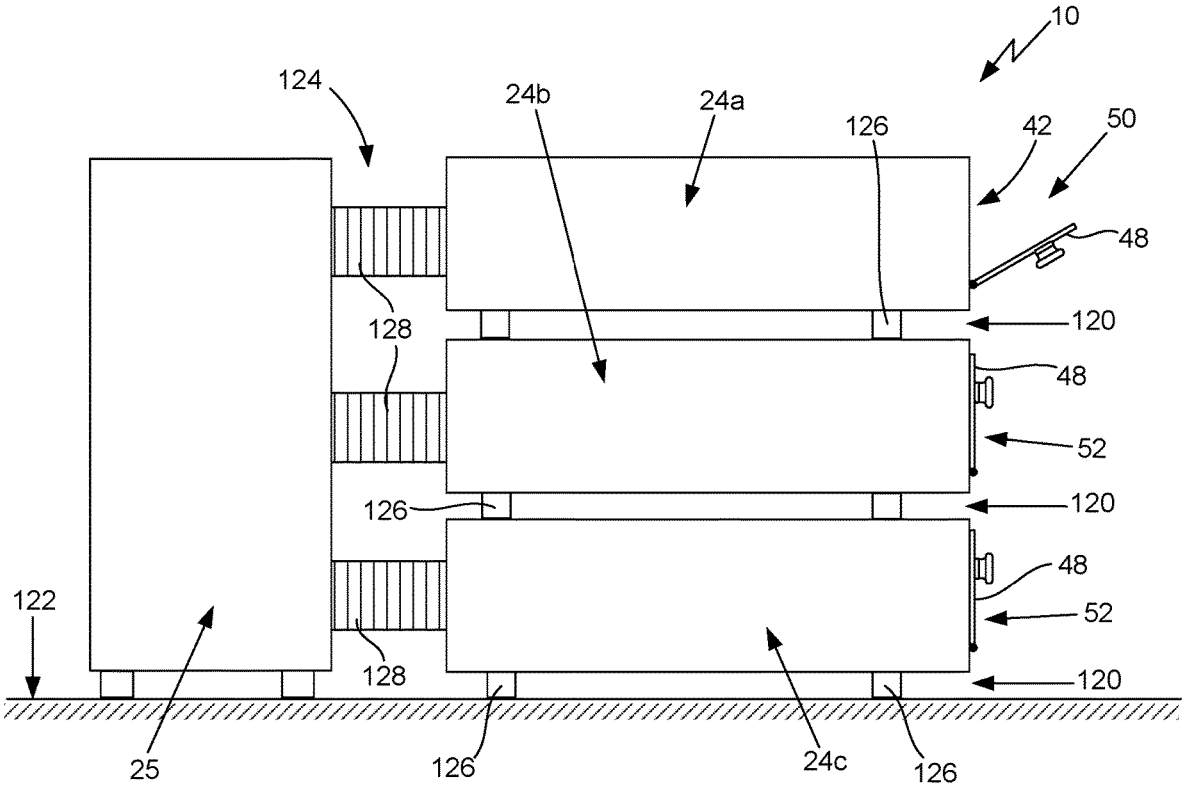
FIG. 15 is a side view of a refrigerated oven that is configured according to a fourth embodiment of the present invention showing use of multiple cooking units separated by air spaces and the cooking units separated from the refrigerator unit by an air gap.

In another embodiment using multiple cooking compartments 24, such as shown with regard to the embodiment of FIG. 15, there will be an air space 120 between each adjacent cooking compartment 24 (such as between first cooking compartment 24*a* and the second cooking compartment 24*b*), an air space 120 between the lowest or bottom cooking compartment 24*c* and the support surface 122 on which it rests, and an air gap 124 between the cooking compartments 24 and the refrigerator unit 25 to prevent heat or cold transference between the cooking compartments 24 and between the cooking compartments 24 and the refrigerator unit 25. In the embodiment shown in FIG. 15, the air spaces 120 are defined by the use of "feet" or other support members 126 that are attached to or integral with the bottom wall 84*f* of the cooking compartments 24. As also shown in FIG. 15, cold air from the refrigerator unit 25 can be transferred to the cooking compartments 24 via one or more air ducts 128 that interconnect the refrigerator unit 25 with each of the cooking compartments 24.

Associated with each cooking compartment 24 of the new refrigerated oven 10 is a compartment door 48, as best shown in FIGS. 1-2, that is placed in an open position 50, as shown in FIG. 1 with regard to the first cooking compartment 24*a*, to receive or remove a food item 14 from the interior chamber 42 and which is placed in a closed position 52, as shown in FIG. 1 with regard to the second and third cooking compartments 24*b*/24*c* and with all of the cooking compartments 24*a*/24*b*/24*c* in FIG. 2. As will be readily appreciated by persons skilled in the relevant art, the compartment door 48 can be attached to, connected to, slidably engaged with or otherwise associated with the one of the walls 28 of the cooking compartment 24. In the embodiments of the refrigerated oven 10 shown in the figures, a compartment door 48 is pivotally attached, by use of a hinge 54, to the front wall 28*a* of each of the cooking compartments 24, as best shown in FIG. 2, to allow the food item 14 to be placed in and removed from the interior chamber 42. As will also be readily appreciated by persons skilled in the art, the compartment door 48 must be structured and arranged to provide sufficient insulating properties (for the relevant reasons discussed above), cooperatively configured with the wall 28 to sealably close and sized and configured to allow the user 16 to easily move the food item 14 in and out of the interior chamber 42. In the embodiment shown in FIGS. 1-2, the compartment door 48 comprises or is a glass window 56 that allows the user 16 to see the food item 14 while it is positioned inside the interior chamber 42 (on the item surface 44). For the convenience and safety of the user 16, as well as for ease of opening and closing the compartment door 48, the compartment door 48 can have a user access device 58, such as a door knob, handle or the like, as shown in FIGS. 1-3 and 6-10.

Associated with each cooking compartment 24 of the new refrigerated oven 10 is a cooking mechanism 60, best shown in FIGS. 3-5, that is configured to provide sufficient heat to cook the food items 14 that are desired to be cooked by the refrigerated oven 10 of the present invention. For purposes of describing the present invention, the cooking mechanism 60 can be any type of mechanism which is utilized by an oven to cook food, including mechanisms that are presently utilized for conventional ovens, microwave ovens, toaster ovens, convection ovens and the like. The configuration and use of such cooking mechanisms 60 are well known to persons skilled in the art. In a preferred configuration of the new refrigerated oven 10, each cooking compartment 24 has its own cooking mechanism 60 so that the user 16 can, as described below, independently set and control each cooking compartment 24 to take into account whether the cooking compartment 24 has a food item 14 in the interior chamber 42 or not and, if it does, to set and control the temperature and duration at which the food item 14 will be cooked. As will be readily appreciated by persons skilled in the art, food items 14 commonly have different cooking temperature and duration requirements depending on the type of ingredients, quantity of ingredients and the desired "done" condition of the cooked food item 14. The cooking mechanism 60 will be selected and arranged with, typically within, the interior chamber 42 of the cooking compartment 24 so the cooking mechanism 60 can provide sufficient heat for the desired amount of time to thoroughly cook the food item 14 that was placed into the cooking compartment 24.

Preferably, the cooking mechanism 60 should be arranged in the interior chamber 42 so as to not interfere with or harm the user 16 through unintentional incidental contact with the user 16 as he or she places the food item 14 in the interior chamber 42 or removes the food item 14 therefrom.

Also associated with each cooking compartment 24 is a control device 62 that is operatively connected to the refrigerator unit 25 and cooking mechanism 60 so as to control the cooling/heating operation of the cooking mechanism 60 with regard to cooling and heating the food item 14 in that cooking compartment 24. As explained in more detail below, the control device 62 is configured to allow the user 16 to set when cooking of the food item 14 will start, the temperature at which to cook the food item 14 and the amount of time the food item 14 will be cooked (with the start time, cooking temperature and cooking time collectively referred to as the cooking instructions 64 in FIG. 11). The control device 62 also allows the user 16 to set how long the food item 14 will be cooled, if it is cooled at all, while the food item 14 is inside the interior chamber 42 of cooking compartment 24 prior to being cooked. In some configurations, the control device 62 will also allow the user 16 to control whether the food item 14 is kept frozen or merely cooled (i.e., at 40° F.) by the refrigerator unit 25. In one use of the present invention, the user 16 will remove the food item 14 from their regular refrigerator and place the food item 14 inside the interior chamber 42 of the cooking compartment, operate the control device 62 to select the option of keeping the food item 14 refrigerated (as opposed to keeping it at room temperature) and set the cooking instructions 64 for the food item 14. When cooking food items 14 in multiple cooking compartments 24, the user 16 will select refrigeration or not and set the cooking instructions 64 for each cooking compartment 24 in which a food item 14 is placed.

In the embodiments shown in the figures, there is a control device 62 attached to or integrally formed with the front wall 28*a* and/or the compartment door 48 of each cooking compartment 24, as shown in FIGS. 1 and 2. In other embodiments, there may be one control device 62, typically placed separate from the compartment doors 48, that controls all of the cooking compartments 24 of the refrigerated oven 10. In this embodiment, the control device 62 will be configured to allow the user 16 to select which of the cooking compartments 24 he or she is setting the cooling option and cooking instructions 64. In yet other embodiments, the control device 62 is incorporated integrally into the housing 22, cooking compartment 24, refrigerator unit 25 or any other component of the refrigerated oven 10. In any configuration, the control device 62 is configured to allow the user 16 to selectively control each cooking compartment 24 so he or she can take into account the cooling/cooking requirements for the food item 14 that is placed therein. As is well known to persons who are skilled in the art, a wide variety of electronic controls and user interfaces for those controls can be utilized with the refrigerated oven 10 of the present invention, including keypads, dials, buttons, touch screens and the like. In other embodiments, the new refrigerated oven 10 does not have any external access panel or the like and is, instead, only accessed and operatively controlled by the user 16 through an electronic device such as a smart phone, tablet, laptop computer, computer or the like while located at the home or other location where the refrigerated oven 10 is located. As set forth in more detail below, in a preferred configuration of the refrigerated oven 10 of the present invention, the user 16 will be able to remotely access the control device 62 by using a smart phone, tablet, laptop computer, desktop computer or like electronic device so that he or she can set, change or cancel the cooking instructions 64 as needed. Preferably, prior to starting the cooking process, the new refrigerated oven 10 will remotely contact the user 16 to send him or her a reminder that cooking is about to begin and inquire of the user 16 of whether or not he or she would like to keep the current schedule or make one or more changes to the cooking process. This will allow the user 16 to confirm the schedule or move up or push back the eating time 18 and/or one or more other settings. If the eating time 18 is pushed back, even to a later date, the refrigerator oven 10 of the present invention will keep the food item 14 at the recommended and safe temperature until the food item 14 is cooked.

As set forth above, the refrigerator unit 25 is structured and arranged to deliver cold air into the interior chamber 42 of the cooking compartment 24 so as to refrigerate the food item 14 that was placed therein by the user 16. To provide the cold air that is necessary to keep the food items 14 cool, the refrigerator unit 25 has a refrigeration mechanism 66 that is structured and arranged (in the same or a similar manner to standard refrigerators) to draw air, typically ambient air, into the refrigerator unit 25 and to discharge cold air from the refrigerator unit 25 into the space to be cooled. For the new refrigerated oven 10, the cold air is discharged, as desired by the user 16 and set through control device 62, from the refrigerator unit 25 into one or more interior chambers 42 of the cooking compartments 24 to keep any food items 14 in the subject interior chambers 42 cool (refrigerated) until the food item 14 is cooked by the cooking mechanism 60 according to the cooking instructions 64. A variety of different types of refrigeration mechanisms 66 can be utilized with the refrigerated oven 10 of the present invention. As with the cooking mechanism 60, most such refrigeration mechanisms 66 are electrically operated (though not exclusively). The configuration and use of such refrigeration mechanisms 66 are well know to persons who are skilled in the relevant art.

As set forth above, the new refrigerated oven 10 and system 12 for cooking food items 14 comprises one or more air flow doors 26 that are structured and arranged to allow the user 16 to control the flow of cold air from the refrigerator unit 25 into the interior chamber 42 of the cooking compartment 24. In use, the air flow doors 26 are utilized to either allow or prevent fluid flow (air) communication between the refrigerator unit 25 and the interior chamber 42 of the respective cooking compartment(s) 24. As such, when the air flow doors 26 are closed, fluid flow communication between the cooking compartment 26 and the refrigerator unit 25 will be prevented, thereby preventing cold air from the refrigeration mechanism 66 of the refrigerator unit 25 to flow into the interior chamber 42 of the cooking compartment 24 and preventing heated air from the cooking mechanism 60 to flow into the refrigerator unit 25. When the air flow doors 26 are open, as selected by the user 16, cold air will flow from the refrigerator unit 25 into the interior chamber 42 of the cooking compartment 26 to keep a food item 14 sufficiently cold (i.e., to prevent spoilage) while the food item 14 is in the interior chamber 42 of the cooking compartment 24 waiting to be cooked. When the cooking process is to start, as set by the cooking instructions 64, the air flow doors 26 will close to stop cold air from flowing into the interior chamber 42 and to prevent heated air from the cooking mechanism 60 from flowing into the refrigerator unit 25 while the food item 14 is being cooked in the cooking compartment 24. As will be readily appreciated by persons who are skilled in the art, the air flow doors 26 and the operating mechanism associated therewith need to be structured and arranged to accomplish the above and, in the preferred embodiments, to be controlled by the control device 62.

Figure 6:
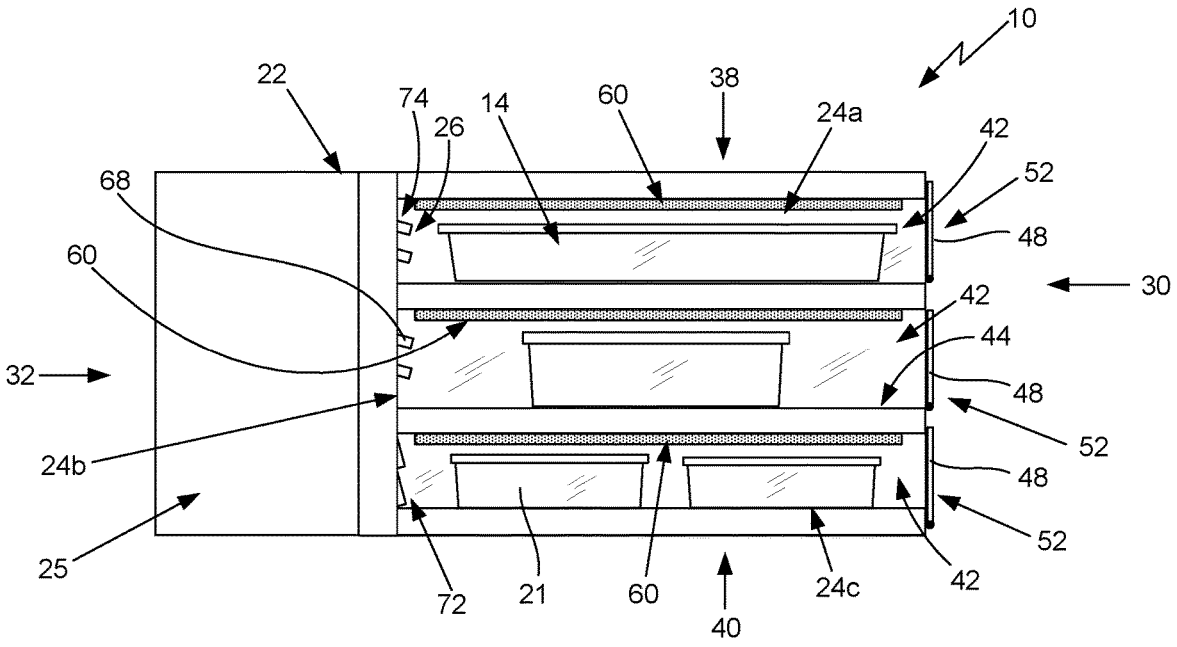
FIG. 6 is a left side view of the refrigerated oven of FIG. 3 shown with the left side wall of cooking compartment area of the housing shown as transparent so as to better illustrate a food item positioned in each cooking compartment with the air flow doors into the first and second cooking compartments in their open position to allow cold air to flow into the first and second cooking compartments from the refrigerator unit to keep the food items therein cool and with the air floor doors into the third cooking compartment shown closed for a non-refrigerated food item.
Figure 7:
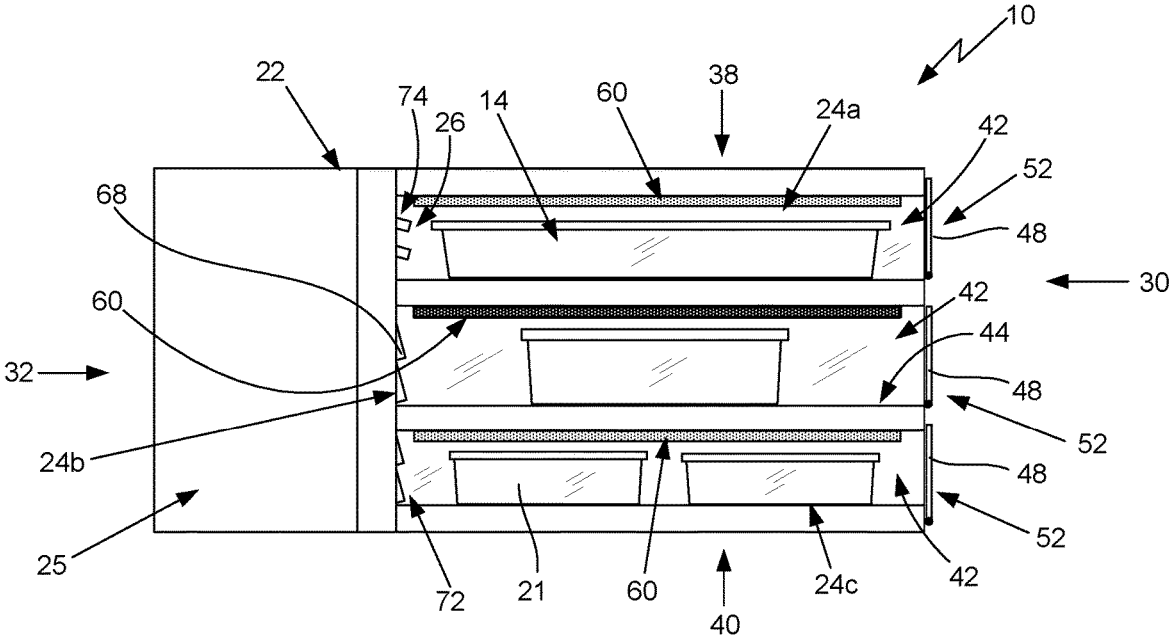
FIG. 7 is a left side view of the refrigerate oven of FIG. 6 showing the air flow door into the second cooking compartment in its closed position and the food item located therein being cooked by the cooking mechanism associated therewith.
Figure 8:
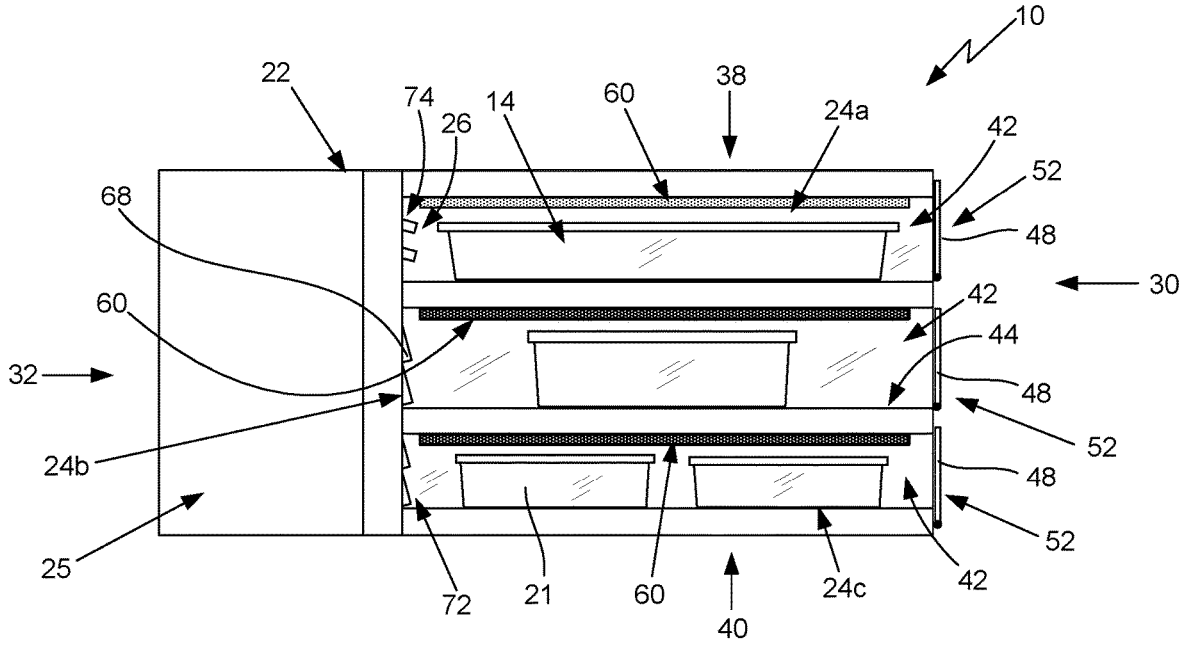
FIG. 8 is a left side view of the refrigerated oven of FIG. 7 showing the food item located in the third cooking compartment also being cooked by the cooking mechanism associated therewith.
Figure 9:
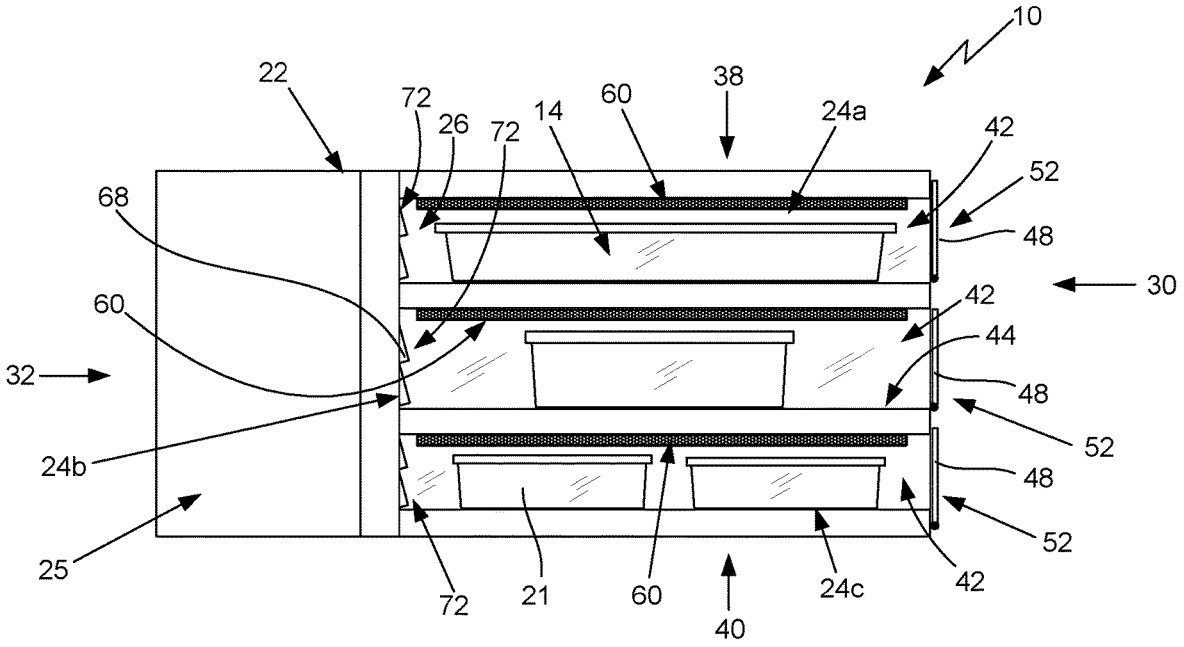
FIG. 9 is a left side view of the refrigerated oven of FIG. 8 showing the air flow door into the first cooking compartment in its closed position and the food item located therein also being cooked by the cooking mechanism associated with the first cooking compartment.
Figure 12:
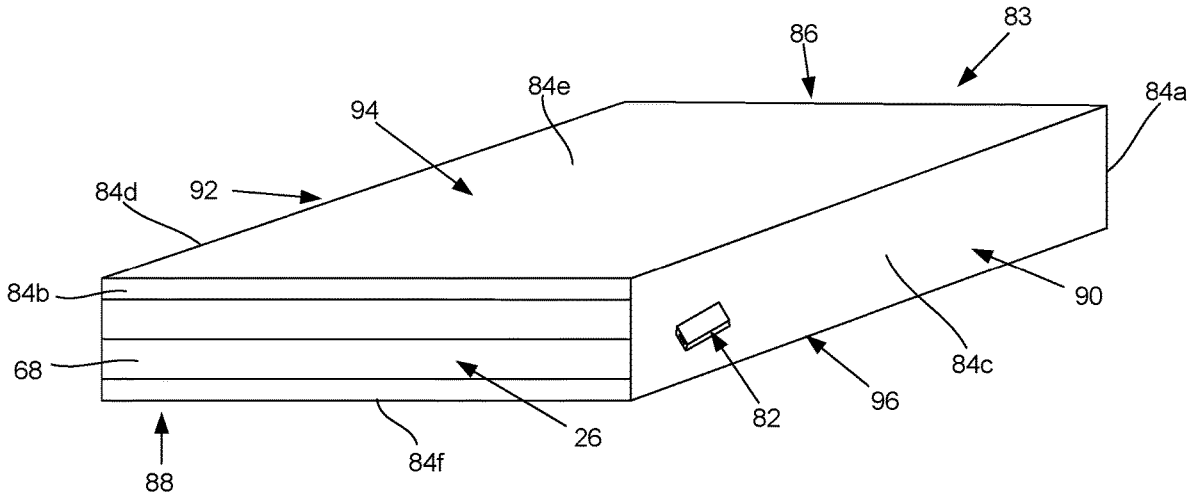
FIG. 12 is a back perspective view of a cooking compartment of a refrigerated oven that is configured according to a second embodiment of the present invention wherein the cooking compartment is removable from the refrigerator unit, with the air flow doors thereof shown in their closed position.

The air flow doors 26 comprise one or more door members 68 and a door operating mechanism 70 associated with the door members 68 so as to move the air flow doors 26 between a closed position 72, as shown in FIGS. 4 and 12, and an open position 74, shown in FIGS. 5-6. The door members 68 are selected so as be able to block heated air from the cooking compartment 24 and cold air from the refrigerator unit 25 from flowing out of their respective areas when the air flow doors 26 are in their closed position 72. The door operating mechanism 70 is structured and arranged to move the door members 68 so as to, selectively, place the air flow doors 26 in one of the closed position 72 or the open position 74. To prevent cold air from undesirably flowing into the cooking compartment 24 and hot air undesirably flowing into the refrigerator unit 25, the door members 68 must be sized and configured to block fluid flow communication between the cooking compartment 24 and the refrigerator unit 25 and be configured so as to at least reduce, if not eliminate, heat transfer between these two components. As such, the door members 68 of the air flow doors 26 must be made out of materials that reduces or prevents such heat transfer, either on their own accord or with insulated materials, such as those described above for the walls 28. The door members 68 also must be selected to allow the door operating mechanism 70 to move the air flow doors 26 between its closed position 72 and open position 74.

In one configuration, the air flow doors 26 comprise a single door member 68 for each cooking compartment 24 of the refrigerated oven 10, thereby requiring three door members 68 for the embodiments shown in the figures, that are independently operated by a single door operating mechanism 70 to open or close. In other embodiments, the air flow doors 26 can comprise more than one door member 68 for each cooking compartment 24. In the embodiments shown in the figures, the refrigerated oven 10 has a door operating mechanism 70 that is associated with each door member 68 or set of door members 68, requiring three door operating mechanism 70 for the embodiments shown in the figures. In either configuration the door operating mechanisms 70 are connected to the control device 62 (likely to be independently connected when multiple door operating mechanisms are utilized). As best shown in FIGS. 4-5 and 12, the air flow doors 26 can comprise a plurality of door members 68 that are configured in a louvered fashion such that the door members 68 pivot to open and close to, respectively, place the air flow doors 26 in their open position 74 or closed position 72. As stated above, in other embodiments, the air flow door 26 associated with each cooking compartment 24 can have a single door member 68. In any configuration, the door members 68 of the air flow doors 26 should be able to be sufficiently sealed when they are the closed position 72 to, at least substantially, prevent any air flow communication between the cooking compartment 24 and the refrigerator unit 25 when the air flow doors 26 are in their closed position 72.

The door operating mechanism 70 is operatively connected to the door members 68 and, preferably, operatively (typically electronically) connected, to the control device 62 so the door operating mechanism 70 can open and close the door members 68 and the control device 62 can control the operation of the air flow doors 26. As such, the control device 62 should be configured to be able to direct the door operating mechanism 70 to keep the air flow doors 26 in the closed position 72 if the food item 14 inside the interior chamber 42 does not need to be cooled, place the air flow doors 26 in their open position 74 to allow cold air to flow into the interior chamber 42 to keep the food item 14 located therein cold (as may be needed) and then place the air flow doors 26 in their closed position 72 when the food item 14 is being cooked so as to keep hot air from entering the refrigerator unit 25 and to improve the heating efficiency of the cooking mechanism 60 of the cooking compartment 24. The door operating mechanism 70 can be structured and arranged to open/close the door members 68 in a wide variety of different manners. In what may be one of the preferred embodiments, the door operating mechanism 70 can be configured to pivot the door members 68 to open and close the air flow doors 26 to allow or prevent fluid flow communication between the cooking compartment 24 and the refrigerator unit 25, as shown with regard to FIGS. 4-5 and with regard to FIGS. 6-9. In this embodiment, the door members 68 are pivotally associated with (as set forth below), one of the cooking compartment 24, refrigerator unit 25 or an independent structure that is associated with the air flow doors 26 and positioned between the cooking compartment 24 and the refrigerator unit 25. Alternatively, the door operating mechanism 70 can be configured to allow or prevent air flow communication by rolling the door members 68 up or down, sliding the door members 68 to the left or right or moving the door members 68 in any manner which prevents or allows fluid flow communication when the air flow doors 26 are, respectively, in their closed position 72 or their open position 74.

In the embodiment of FIGS. 1-9, the refrigerated oven 10 is a single, integral unit and the air flow doors 26 are pivotally associated with the side walls 28*c*/28*d* between the refrigerator unit 25 and the interior chamber 42 so as to allow or prevent air flow between the cooking compartment 24 and the refrigerator unit 25 to not cool, cool or cook a food item 14 inside the interior chamber 42. As such, the air flow doors 26 will define the intersection of the cooking compartment 24 and the refrigerator unit 25. In embodiments where the cooking compartment and the refrigerator unit 25 are physically separate or able to be separated components, the air flow doors 26 are attached to the cooking compartment 24, the refrigerator unit 25 or attached to a separate component that is disposed between the cooking compartment 24 and refrigerator unit 25 so as to place the cooking compartment 24 and refrigerator unit 25 in fluid flow communication. In the configuration where the cooking compartment 24 is separable from the refrigerator unit, as shown with regard to FIGS. 12-13, the door operating mechanism(s) 70 can be associated with the same component the air flow doors 26 are associated with (i.e., pivotally attached to) or the door operating mechanism(s) 70 can be associated with the other component or one of the other components. For instance, the embodiment of FIGS. 12-13 show the air flow doors 26 being operatively associated with the cooking compartment 24 and the door operating mechanisms 70 associated with the refrigerator unit 25.

Figure 13:
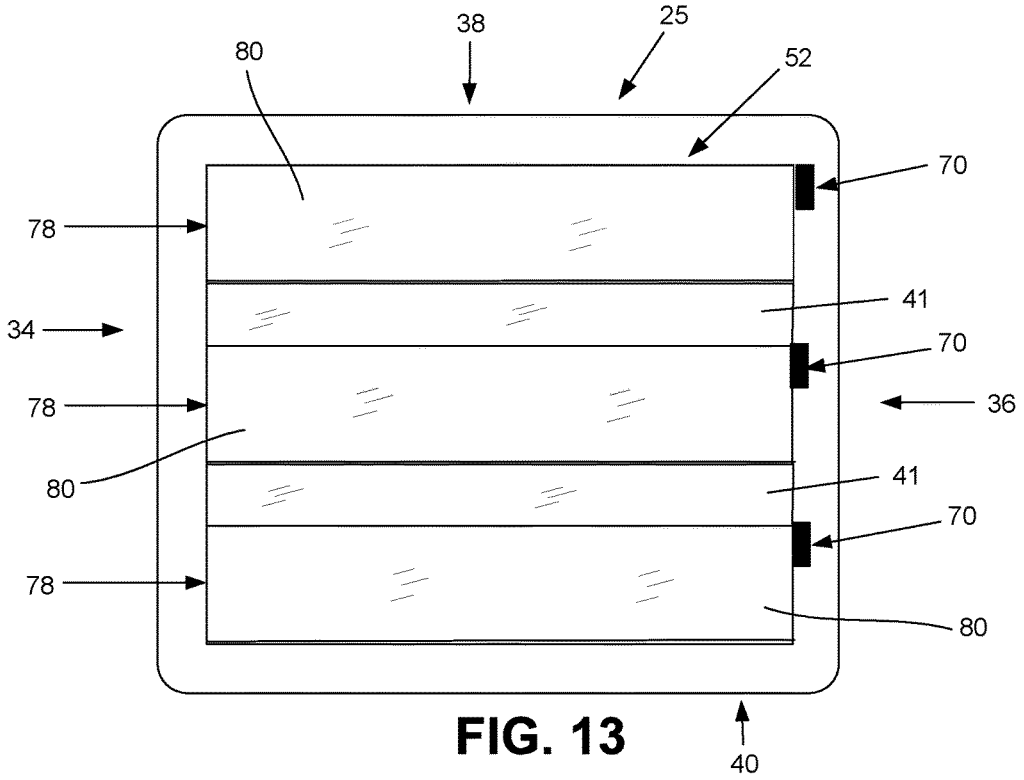
FIG. 13 is a front view of a refrigerator unit of the refrigerated oven of FIG. 12, with the refrigerator unit configured to be utilized as a docking station to removably receive the cooking compartment of FIG. 12 into a passageway having barrier at the passageway opening.

In the embodiment of FIGS. 12-13, the cooking compartment 24 is able to be separated from one refrigerator unit 25 and then either connected to that refrigerator unit 25 (i.e., at a later time) or to another refrigerator unit 25 (such as one in a different location) in a manner that operatively connects the air flow doors 26 with the door operating mechanism 70, one for each set of louvered door members 68, so the control device 62 will be able to independently operate the door operating mechanism(s) 70 to open the door member(s) 68 of the air flow door 26 associated with the cooking compartment 24 in which a food item 14 is positioned so it can be kept cool and then cooked. In effect, the refrigerator unit 25 will function as a docking station for one or more cooking compartments 24. As shown in FIGS. 12-13, the housing 22 defines one or more cooking compartment passageways 76, having passageway openings 78 at one wall 28 of the housing 22, that are sized and configured to removably receive a cooking compartment 24. For instance, in the embodiment shown in the figures, the refrigerator unit 25 has three separate passageways 76 that are each sized and configured to receive a cooking unit 24 therethrough so as to place the interior chamber 42 of the cooking unit 24 in fluid flow communication with the refrigerator unit 25 when the air flow doors 26 are in their open condition 74. To prevent cold air from escaping through an open passageway 76 (i.e., one that does not have a cooking unit 24 positioned therein), the refrigerator unit 25 has a barrier 80 that is movably associated with each passageway 76, as shown in FIG. 13, which is configured to block cold air from exiting the refrigerator unit 25 through the subject passageway 76. In the embodiment shown in FIG. 13, the barrier 80 is pivotally attached to the side walls of the refrigerator unit 25 in a manner which allows the barrier 80 to pivot open when a cooking compartment 24 is pushed against the barrier 80, through the passageway 76 and into the refrigerator unit 25. As also shown in FIG. 13, each cooking compartment 24 has one or more engaging mechanisms 82 associated therewith that engage with the door operating mechanism 70 of the refrigerator unit 25 to operatively connect the air flow doors 26 and control device 62 of the cooking compartment 24 to the door operating mechanism 70. As set forth above, this embodiment allows the user 16 to have one set of cooking compartments 24 and more than one refrigerator unit 25, such as having refrigerator units 25 at his or her home and also at an office, RV, boat or other location, that are each structured and arranged to removably receive, cool and heat a cooking compartment 24.

In the embodiment where the cooking compartment 24 is removable from the housing 22, referred to herein as removable cooking compartment 83, the removable cooking compartment 83 has a plurality of insulated walls 84 that define a front end 86, back end 88, first or left side 90, second or right side 92, top side 94 and bottom side 96, as shown in FIG. 12. In the embodiment where the cooking compartment 24 has a generally rectangular shape, the walls 84 comprise a back wall 84*b*, first/left wall 84*c*, second/right wall 84*d*, top wall 84*e* and bottom wall 84*f*. In certain embodiments of the refrigerated oven 10, the air flow doors 26 are attached to or integral with the back end 88 of the removable cooking compartment 83, as shown in FIG. 12. In other configurations of this embodiment, the air flow doors 26 can be operatively associated with the refrigerator unit 25 or be part of a separate component positioned between the removable cooking compartments 83 and the refrigerator unit 25, instead of the removable cooking compartment 83. The refrigerator unit 25 of FIG. 13, which is configured for use with removable cooking compartments 83, is configured to removably receive and operatively connect to three removable cooking compartments 83.

Figure 14:
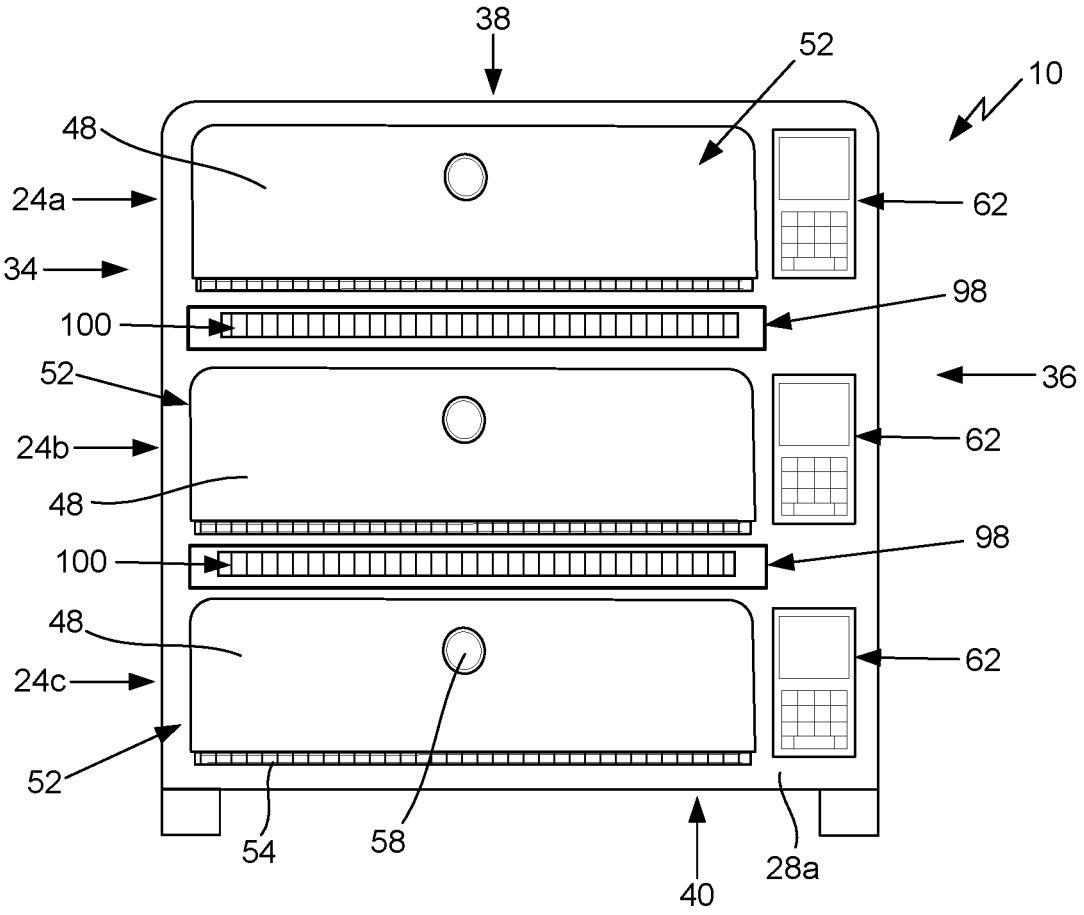
FIG. 14 is a front view of a refrigerated oven that is configured according to a third embodiment of the present invention showing use of air flow vents between adjacent cooking compartments and a source of air in fluid flow communication with the air flow vents.

The embodiment of FIG. 14 shows a refrigerated oven 10 that, in addition to being configured as set forth above, provides improved heat transfer flow prevention between a pair of adjacent cooking compartments 24. As will be readily appreciated by persons who are skilled in the relevant art, if not prevented by sufficient insulation or other means, heat from one cooking compartment 24 could affect the cold air cooling of an adjacent cooking compartment 24, which could cause the food item 14 to spoil due to the food item 14 not being kept sufficiently cold until it is cooked. The previously described embodiments rely on the materials and insulation, if any, associated with the divider wall 41 to prevent undesirable heat transfer between adjacent cooking compartments 24. The refrigerated oven 10 of FIG. 14 has one or more air flow vents 98 that are utilized to further separate one cooking compartment 24 from another to reduce the likelihood that heat from the cooking mechanism 60 of one cooking compartment 24 will negatively affect the cooling of a food item 14 in an adjacent cooking compartment 24. In one configuration, the air flow vents 98 are open areas disposed between two adjacent cooking compartments 24 that take advantage of lower temperature ambient air to reduce the likelihood of undesirable heat transfer. In another embodiment, the air flow vents 98 are connected to a fan or other source of air 100, as shown in FIG. 14, that is configured to discharge air through the air flow vents 98 to direct any stray heat away from an adjacent cooking compartment 24. The fan or other source of air 100 can be positioned in fluid flow communication with the air flow vents 98 to blow air from at or near the back end 32 of the refrigerated oven 10, out of the air flow vents 98 and away from the front end 30 of the refrigerated oven 10. If desired, the source of air 100 can be connected to or integral with the refrigerator unit 25 and blow either ambient air, cooled ambient air or refrigerated air. In either configuration, the source of air 100 can be operatively connected to the control device 62 to only blow air through the air flow vents 98 when one cooking unit 24 is cooking a food item 14 and the adjacent cooking unit 24 is keeping a food item 14 cold. The configuration and use of fans and other sources of air 100 are well known to persons who are skilled in the relevant arts.

The embodiment of FIG. 15 shows a refrigerated oven 10 that, in addition to being configured as set forth above, also improved heat transfer flow prevention between pairs of adjacent cooking compartments 24 and between the cooking compartments 24 and the refrigerator unit 25. As set forth above, in this embodiment of the refrigerated oven 10, there is an air space 120 between each of the cooking compartments 24*a*/24*b*/24*c*, which is provided by the feet or other support members 126 associated with each cooking compartment 24, and an air gap 124 between all of the cooking compartments 24 and the refrigerator unit 25, which are in air-flow connection by the air ducts 128, as shown in FIG. 15. The air spaces 120 and the air gap 122 will reduce the likelihood of undesirable heat transfer between the various cooking compartments 24 and between the cooking compartments 24 and the refrigerator unit 25. In the configuration shown in FIG. 15, the cooking compartments 24 and refrigerator unit 25 are separate, individual components that are placed on each other or the support surface 122, for the cooking compartments 24, or near each other, with regard to the refrigerator unit 25 and the cooking compartments 24. In another configuration of this embodiment, two or more cooking compartments 24 can be grouped together in a housing which is sized and configured to enclose the cooking compartments 24 and the group of cooking compartments 24 can be connected to the refrigerator unit 25 by one or more air ducts 128. In yet another configuration of this embodiment, each of the cooking compartments 24, refrigerator unit 25 and air ducts 128 can be collectively enclosed by a separate housing.

Figure 10:
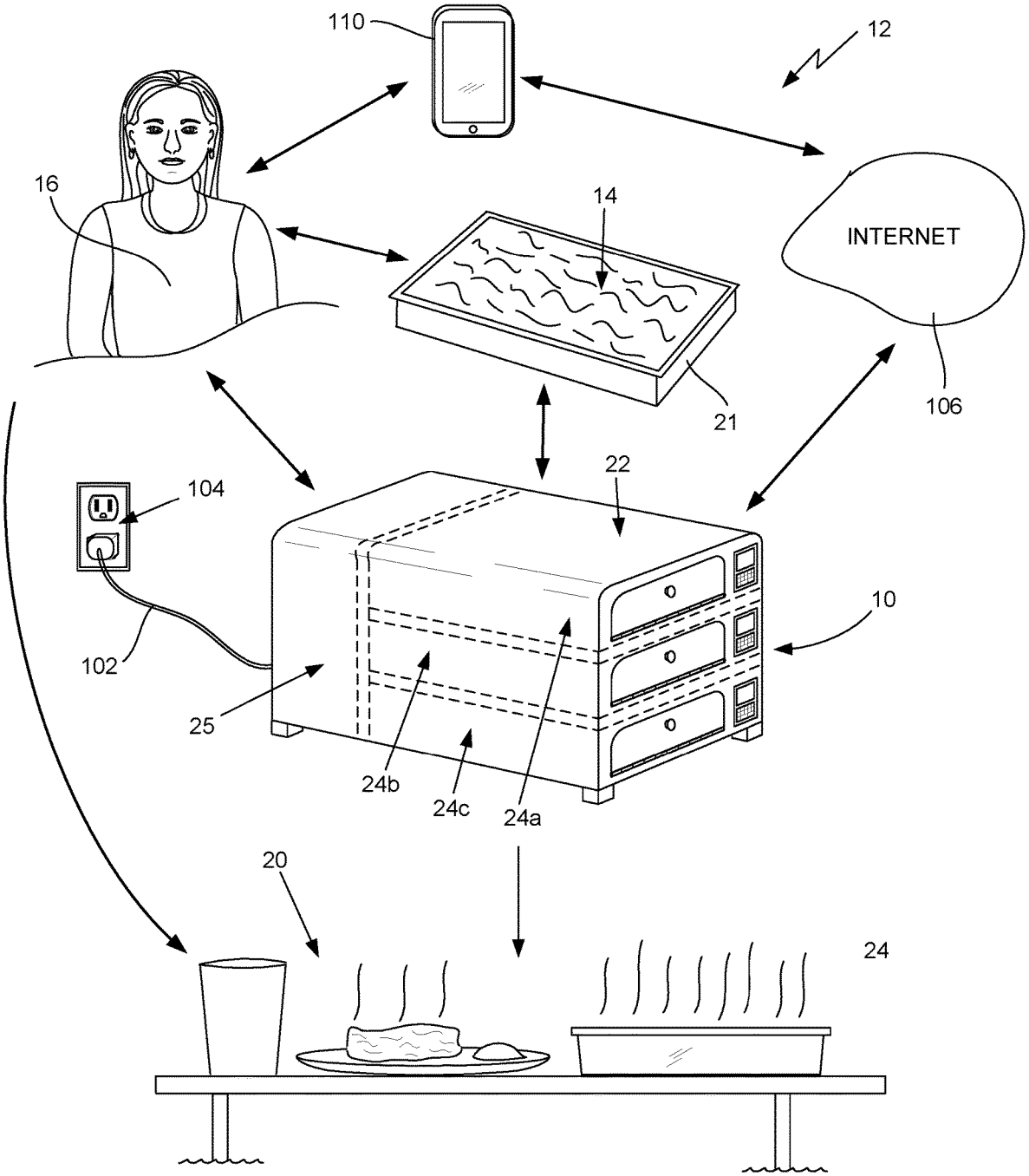
FIG. 10 is an illustration of one embodiment of the system for cooking food items of the present invention, with the system showing use of the refrigerated oven of FIG. 1.

In a preferred configuration of the present invention, the refrigerated oven 10 has an electrical power cord 102, as shown in FIGS. 1, 3 and 6-9, that is utilized to connect the refrigerated oven 10 to a source of electrical power 104, such as an electrical outlet shown in FIG. 10. In this embodiment, the cooking mechanism 60 of the cooking container 24, the refrigeration mechanism 66 of the refrigerator unit 25, the control device 62 and the door operating mechanism 70 are electrically operated and connected to the source of power 104 via the power cord 102. If utilized and configured as a separate component, the fan or other source of air 100 is also electrically operated and, therefore, electrically connected to the source of power 104 via the power cord 102. As will be readily appreciated by persons skilled in the art, the refrigerated oven 10 can connect directly to a source of electrical power 104, bypassing the need for the power cord 102, and a variety of other sources of power, such as gas or the like, can be utilized to power one or more of the components of the refrigerated oven 10, which will connect to the refrigerated oven 10 via a gas line or other power connecting device.

Figure 11:
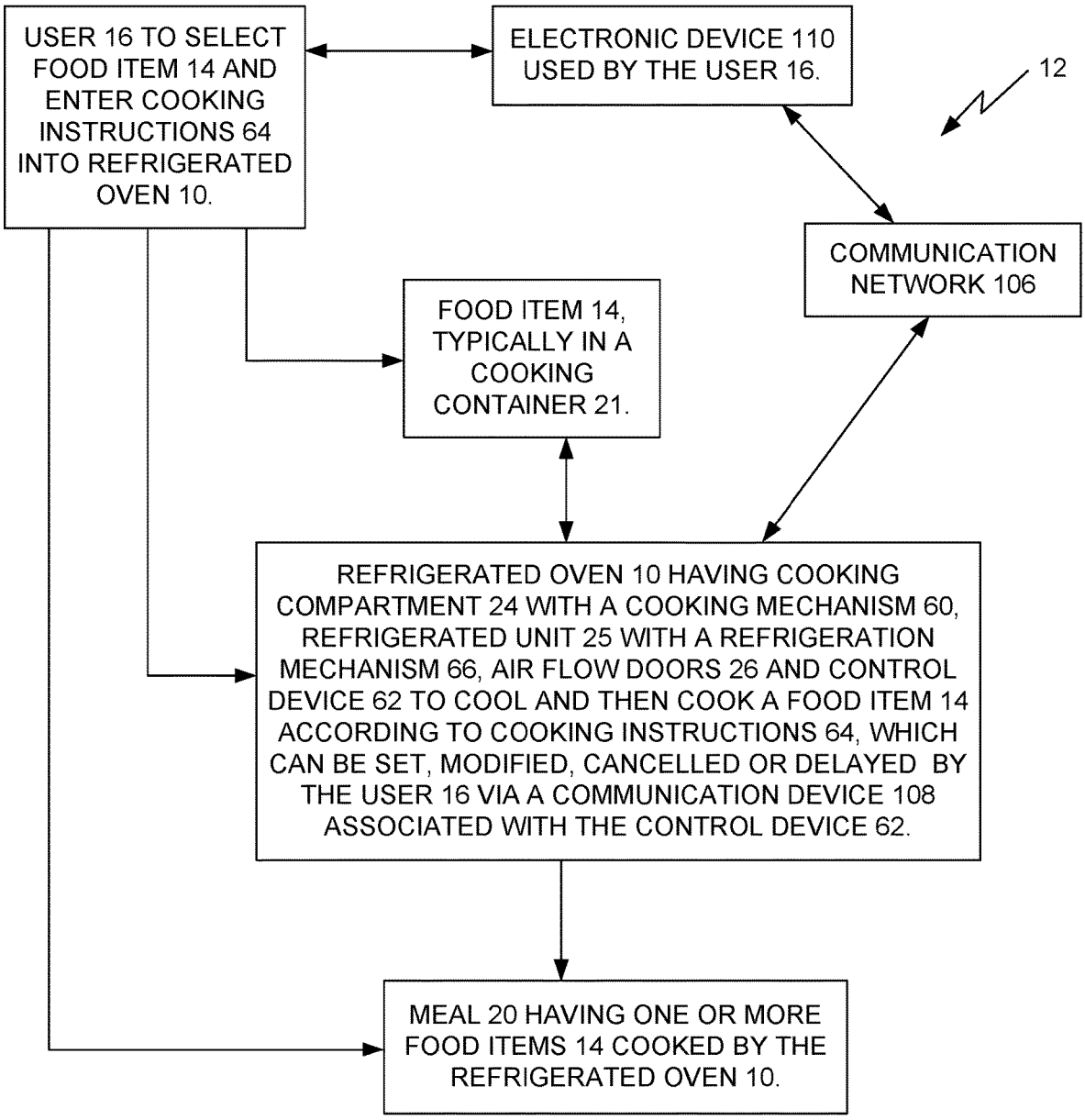
FIG. 11 is a chart summarizing the system of FIG. 10.

The system 12 for cooking food items 14 of the present invention, shown in FIGS. 10-11, comprises the refrigerated oven 10 having the various components and features described above, at least one food item 14, a user 16, a source of power 104 and a power connecting device (such as the power cord 102) to connect the refrigerated oven 10 to the source of power 104. In a preferred embodiment, the system 12 also comprises a communication network 106, a communication device 108 that is associated with the refrigerated oven 10 and a properly configured electronic device 110 that allows the user 16 to remotely access or connect to the control device 62 of the refrigerated oven 10, via the communication network 106 and communication device 108, in a manner which allows the user 16 to view, set, reset, start, pause and/or stop the cooking process for the food item 14 by accessing and, as may be desired or necessary, modifying the cooking instructions 64.

The communication network 106 can be any type of system that allows an electronic data signal to be transmitted to the communication device 108 of the refrigerated oven 10 by utilizing an electronic device 110. In one preferred embodiment the communication network 106 is the internet. As will be readily appreciated by persons skilled in the art, however, the communication network 106 can be any internet-based service, cellular system, radio, satellite, wifi, Bluetooth® or the like, as may be appropriate to receive and transmit electronic data signals from or on behalf of the user 16 via the electronic device 110.

The communication device 108, which is operatively connected to the control device 62 of the new refrigerated oven 10 and powered by the source of power 104, can be any device which is configured to operatively connect to the user 16 via the communication network 106 and receive and transmit electronic data signals, as shown in FIGS. 10-11. Typically, the communication device 108 will comprise an antenna or other signal-receiving component, including being connected to the communication network 106 via a wire, cable or the like, that is configured to receive an electronic data signal from the communication network 106. The configuration of the signal-receiving communication device 108 will depend on the type of communication network 106 utilized with the refrigerated oven 10 of the present invention. Typically, the control device 62 and/or the communication device 108 will have one or more processors and digital storage media, as may be appropriate, that processes the electronic data signal that is received from the user 16 via the communication network 106 by the signal-receiving communication device 108.

The electronic device 110 can be a smart phone, tablet, laptop computer, desktop computer, voice-activated virtual assistant device (such as the Amazon ECHO® or the like) or a variety of similar computer-enabled electronic devices that enables the user 16 to connect to and communicate with the control device 62 via the communication network 106 and communication device 108. The electronic device 110 will be configured to allow the user 16 to log onto the control device 62 of his or her refrigerated oven 10 and access the cooking instructions 64 to view, set, reset, start, pause and/or stop the cooking process for the food item 14, as may be desired or necessary. Generally, a computer app or the like will be available to the user to download unto his or her electronic device 110 that will allow the user 16 via appropriate login and password entry, to remotely access and control his or her refrigerated oven 10. For instance, in the scenario of a living arrangement where multiple tenants (i.e., multiple users 16) share a kitchen having multiple refrigerated ovens 10, each refrigerated oven 10 can be assigned to a different user 16 in a manner which allows him or her (and only him or her) to have access to the user's specific refrigerated oven 10 via the computer app or the like from his or her communication device 108 (i.e., smart phone).

The configuration and use of communication networks 106, signal-receiving and transmitting communication devices 108 and electronic devices 110 are generally well known by persons who are skilled in the art. As will be readily appreciated by such persons, the communication networks 106, communication devices 108 and electronic devices 110 that are described above are provided for exemplary purposes only and the present invention is not limited to any one type of such components. In fact, it is very likely and anticipated that in the future there will be new communication networks 106, communication devices 108 and electronic devices 110 that can be beneficially utilized with the refrigerated oven 10 and system 12 of the present invention.

The components of the new refrigerated oven 10 can be made out of various materials. In one embodiment, the housing 22, cooking compartments 24, refrigerator unit 25 are made out of or primarily comprise stainless steel. In other embodiments, some of the components can be made out of other metals, ceramic, glass and/or various composites. The insulating material 46 can be made from or comprise a wide variety of materials that are utilized in the art for insulating items that are heated or kept very cold. If utilized, feet or other support members at the lower surface of the bottom wall 28*f* can be made out of plastic, rubber or the like that allow the refrigerated oven 10 to safely sit on a counter, table, shelf or other support surface without damaging the refrigerated oven and/or the support surface on which it is placed.

In use, the user 16 will connect the refrigerated oven 10 to the source of power 104 using the power cord 102 or another appropriately configured power connecting device. The user 16 will open the compartment door 48, place a food item 14 in the interior chamber 42 of the cooking compartment 24 and then close the compartment door 48. Utilizing the control panel of the control device 62 or an electronic device 110, the user 16 will select, as necessary, the option to keep the food item 14 cold until cooking, which will open the air flow doors 26 to allow cold air to flow from the refrigerator unit 25 into the interior chamber 42 of the cooking compartment, and set the cooking instructions 64 to cook the food item 14. The cooking instructions include setting the time when the air flow doors 26 will close and the cooking mechanism 60 will be activated to heat the interior chamber 42 and cook the food item 14. The cooking instructions 64 also include the time and temperature necessary to cook the food item 14. Typically, the user will set the start time so the food item 14 will be ready to eat at the eating time 18 he or she desires to consume the food item 14. Once the parameters are set, the control device 62 will control the operation of the refrigerated oven 10 to properly store the food item 14 (i.e., refrigerate or not refrigerate) while waiting for the cooking process to start, as determined by the cooking instructions 64, and then to cook the food item 14.

If something comes up during the day that requires the user 16 to want or need to change the cooking instructions 64, the user 16 can do so using an electronic device 110 to connect to the control device 62 via the communication network 106 and communication device 108. For instance, if the user 16 has an opportunity to go out to eat with another person, he or she can cancel the cooking process for the food item 14 and keep it refrigerated until he or she gets home to put the food item 14 back into the refrigerator. Likewise, if the user 16 has to stay late at work, decides to go to the gym or other activity or a child's school, sports, theater or other activity goes long, or even if the user merely decides to not eat the food item 14 that day after the cooking process has started, he or she can easily modify the cooking instructions 64 to delay the cooking process until later in the day and/or set the temperature of the refrigerated oven 10 to a low level to keep a cooked food item 14 warm until he or she gets home to eat the food item 14 or to put the cooked food item 14 in the refrigerator. If desired, the user 16 can choose to leave the food item 14 in the refrigerated cooking compartment 24 for one or more days, as he or she would a standard refrigerator, and then cook and eat the food item 14 when he or she is ready to eat it. Preferably, prior to starting the cooking process, the refrigerated oven 10 will utilize the connection to the communication network (i.e., the internet), via the communication device 108, and the user's electronic device 110 to send the user 16 a reminder that cooking is about to begin and inquire of the user 16 of whether or not he or she would like to keep the current schedule or make one or more changes to the cooking process. This will allow the user 16 to confirm the schedule or move up or push back the eating time 18 and/or one or more other settings. If the eating time 18 is pushed back, even to a later date, the refrigerator oven 10 of the present invention will keep the food item 14 at the recommended and safe temperature until the food item 14 is cooked. In any scenario, the ability for the user 16 to remotely access the control device 62 of the refrigerated oven and modify the cooking instructions 64 will allow the user 16 nearly unprecedented control over the preparation and cooking of his or her meal 20.

Perhaps one of the primary benefits of the new refrigerated oven 10 and system 12 of the present invention is that they will enable to user 16 to either prepare one or more food items 14 for later cooking and consumption and/or to take advantage of food delivery services that will deliver healthy food items 14 to the user 16 for later cooking and consumption. The ability to easily, quickly and safely store and cook food items 14, particularly fresh, healthy food items 14, using the new refrigerated oven 10 and system will make family meal time a hassle-free pleasure instead of something to worry about, plan and (very often) dread having to do. Instead of the hassle of planning and preparing, the user 16 merely has to peel off a plastic or aluminum foil cover from a cooking container 22, place the food item 14 inside the interior chamber 42 of the cooking compartment 24, choose whether to refrigerate the food item 14 prior to cooking, set the cooking instructions 64 and then come home to a fully cooked, ready to eat meal. The food items 14 can be meat, vegetables, deserts or virtually any food that can be prepared in advance and is then cooked for eating. In conjunction with the use of the refrigerated oven 10 and system 12 of the present invention, the present inventor anticipates that one or more companies (likely multiple companies) will take advantage of the availability of the new refrigerated oven 10 and system 12 and provide a home (or other location) delivery service that delivers fresh, healthy meals, comprising one or more ready-to-cook food items 14, usually in a cooking container 21, to the user 16 so he or she can store in the refrigerator until a day and time he or she desires to eat the food item 14, at which point he or she utilizes the new refrigerated oven 10 to cook the food item 14.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor(s) and to enable other persons who are skilled in the relevant art to make and utilize the present invention. Although, the described embodiments may comprise different features, not all of these features are required in all embodiments of the present invention. More specifically, as will be readily appreciated by persons who are skilled in the art, certain embodiments of the present invention only utilize some of the features and/or combinations of features disclosed herein.

What is claimed is:

1. A refrigerated oven for cooking a food item, said refrigerated oven comprising:

a housing having a plurality of walls, said plurality of walls including a front wall and a back wall;

a refrigerator unit disposed in said housing, said refrigerator unit having a refrigeration mechanism structured and arranged to discharge cold air from said refrigerator unit;

a cooking compartment removably associated with said housing and said refrigerator unit, said cooking compartment having an interior chamber sized and configured to removably receive the food item therein and a cooking mechanism structured and arranged to discharge hot air into said interior chamber to cook the food item when the food item is disposed in said interior chamber, said interior chamber disposed in fluid flow communication with said refrigerator unit so as to receive cold air into said interior chamber, said cooking compartment sized and configured to be removably received in a passageway defined by said housing between said refrigerator unit and a passageway opening at one of said walls of said housing when connecting said removable cooking compartment to said refrigerator unit; and an air flow door disposed between said refrigerator unit and said cooking compartment or associated with one of said refrigerator unit and said cooking compartment to prevent air flow between said refrigerator unit and said interior department when said air flow door is in a closed position and to allow air flow between said refrigerator unit and said interior department when said air flow door is in an open position, wherein the food item is kept cold when positioned in said interior chamber with said air flow door in said open position and is cooked by said cooking mechanism with said air flow door in said closed position.

2. The refrigerated oven of claim 1 further comprising a compartment door movably associated with said cooking compartment so as to move between an open position to allow the food item to be placed in or removed from said interior compartment and a closed position to enclose the food item in said interior chamber.

3. The refrigerated oven of claim 1 further comprising a barrier moveably associated with said housing at or near said passageway opening so as to selectively close said passageway to prevent cold air from exiting said housing when said removable cooking compartment is not positioned in said passageway.

4. The refrigerated oven of claim 1, wherein said housing defines a plurality of passageways that are each sized and configured to removably receive one of a plurality of said removable cooking compartments so as to cool and cook a plurality of food items.

5. The refrigerated oven of claim 1 further comprising a control device operatively connected to said cooking mechanism of said cooking compartment so as to control the flow of hot air from said cooking mechanism into said interior chamber according to cooking instructions associated with said control device.

6. The refrigerated oven of claim 5, wherein said control device is also operatively connected to said air flow door so as to place said air flow door in said closed position or said open position to control the flow of cold air from said refrigeration mechanism of said refrigerator unit into said interior chamber.

7. The refrigerated oven of claim 6, wherein said control device has a communication device that is structured and arranged to remotely connect to an electronic device across a communication network.

8. The refrigerated oven of claim 1, wherein said refrigerated oven comprises a plurality of said cooking compartments, each of said cooking compartments in fluid flow communication with said refrigerator unit so as to receive cold air from said refrigerator unit.

9. A refrigerated oven for cooking a food item, said refrigerated oven comprising:

a housing having a plurality of walls, said plurality of walls including a front wall and a back wall;

a refrigerator unit disposed in said housing, said refrigerator unit having a refrigeration mechanism structured and arranged to discharge cold air from said refrigerator unit;

one or more cooking compartments attached to or integral with said refrigerator unit, each of said one or more cooking compartments having an interior chamber sized and configured to removably receive the food item therein and a cooking mechanism structured and arranged to discharge hot air into said interior chamber to cook the food item when the food item is disposed in said interior chamber, said interior chamber disposed in fluid flow communication with said refrigerator unit so as to receive cold air into said interior chamber;

a compartment door movably associated with each of said one or more cooking compartments, said compartment door configured to move between an open position to allow the food item to be placed in or removed from said interior compartment and a closed position to enclose the food item in said interior chamber;

an air flow door disposed between said refrigerator unit and said cooking compartment or associated with one of said refrigerator unit and said cooking compartment to prevent air flow between said refrigerator unit and said interior department when said air flow door is in a closed position and to allow air flow between said refrigerator unit and said interior department when said air flow door is in an open position; and a control device operatively connected to said air flow door so as to place said air flow door in said closed position or said open position to control the flow of cold air from said refrigeration mechanism of said refrigerator unit into said interior chamber and to said cooking mechanism of said cooking compartment so as to control the flow of hot air from said cooking mechanism into said interior chamber according to cooking instructions associated with said control device, wherein the food item is kept cold when positioned in said interior chamber with said air flow door in said open position and is cooked by said cooking mechanism with said air flow door in said closed position.

10. The refrigerated oven of claim 9, wherein at least one of said one or more cooking compartments is a removable cooking compartment that is removably associated with said housing and removably connected to said refrigerator unit, each of said removable cooking compartments being removably received in one of a plurality of passageways defined by said housing between said refrigerator unit and a passageway opening at one of said walls of said housing when connecting said removable cooking compartment to said refrigerator unit.

11. The refrigerated oven of claim 10 further comprising a barrier moveably associated with said housing at or near said passageway opening to selectively close said passageway so as to prevent cold air from exiting said housing when said removable cooking compartment is not in said passageway.

12. The refrigerated oven of claim 10, wherein each of said cooking compartments are said removable cooking compartments and said housing defines a plurality of passageways that are each sized and configured to removably receive one of said removable cooking compartments so as to cool and cook a plurality of the food items with said refrigerated oven.

13. The refrigerated oven of claim 9, wherein said control device has a communication device that is structured and arranged to remotely connect to an electronic device across a communication network.

14. A cooking system, comprising:

a food item to be cooked;

a refrigerated oven having a refrigerator unit disposed in a housing, a cooking compartment attached to or integral with said refrigerator unit, an air flow door disposed between said refrigerator unit and said cooking compartment or associated with one of said refrigerator unit and said cooking compartment and a control device operatively connected to said air flow door, said refrigerator unit having a refrigeration mechanism structured and arranged to discharge cold air from said refrigerator unit, said cooking compartment having an interior chamber sized and configured to removably receive said food item therein and a cooking mechanism structured and arranged to discharge hot air into said interior chamber to cook said food item when said food item is disposed in said interior chamber, said interior chamber disposed in fluid flow communication with said refrigerator unit so as to receive cold air into said interior chamber to cool said food item when said food item is disposed in said interior chamber, said air flow door configured to prevent air flow between said refrigerator unit and said interior department when said air flow door is in a closed position and to allow air flow between said refrigerator unit and said interior department when said air flow door is in an open positions;

a control device associated with said refrigerated oven and operatively connected to said air flow door so as to place said air flow door in said closed position or said open position to control the flow of cold air from said refrigeration mechanism of said refrigerator unit into said interior chamber and operatively connected to said cooking mechanism of said cooking compartment so as to control the flow of hot air from said cooking mechanism into said interior chamber according to cooking instructions;

a communication device associated with said control device of said refrigerated oven;

an electronic device; and a communication network to which said electronic device is connected, wherein said communication device of said control device is structured and arranged to connect to said communication network so as to allow remote connection to said refrigerated oven and said cooking instructions using said electronic device and said communication network, wherein said food item is kept cold when positioned in said interior chamber with said air flow door in said open position and is cooked by said cooking mechanism with said air flow door in said closed position.

15. The system of claim 14, wherein said cooking compartment is a removable cooking compartment sized and configured to be removably received in a passageway defined by said housing between said refrigerator unit and a passageway opening at one of said walls of said housing when connecting said removable cooking compartment to said refrigerator unit.

16. The system of claim 15 further comprising a barrier moveably associated with said housing at or near said passageway opening to selectively close said passageway so as to prevent cold air from exiting said housing when said removable cooking compartment is not in said passageway.

17. A refrigerated oven for cooking a food item, said refrigerated oven comprising:

a housing having a plurality of walls, said plurality of walls including a front wall and a back wall;

a refrigerator unit disposed in said housing, said refrigerator unit having a refrigeration mechanism structured and arranged to discharge cold air from said refrigerator unit;

a cooking compartment attached to or integral with said refrigerator unit, said cooking compartment having an interior chamber sized and configured to removably receive the food item therein and a cooking mechanism structured and arranged to discharge hot air into said interior chamber to cook the food item when the food item is disposed in said interior chamber, said interior chamber disposed in fluid flow communication with said refrigerator unit so as to receive cold air into said interior chamber, said cooking compartment being a removable cooking compartment sized and configured to be removably received in a passageway defined by said housing between said refrigerator unit and a passageway opening at one of said walls of said housing when connecting said removable cooking compartment to said refrigerator unit;

an air flow door disposed between said refrigerator unit and said cooking compartment or associated with one of said refrigerator unit and said cooking compartment to prevent air flow between said refrigerator unit and said interior department when said air flow door is in a closed position and to allow air flow between said refrigerator unit and said interior department when said air flow door is in an open position;

a control device operatively connected to said cooking mechanism of said cooking compartment so as to control the flow of hot air from said cooking mechanism into said interior chamber according to cooking instructions associated with said control device, said control device also operatively connected to said air flow door so as to place said air flow door in said closed position or said open position to control the flow of cold air from said refrigeration mechanism of said refrigerator unit into said interior chamber; and a communication device associated with said control device, said communication device structured and arranged to remotely connect to an electronic device across a communication network, wherein the food item is kept cold when positioned in said interior chamber with said air flow door in said open position and is cooked by said cooking mechanism with said air flow door in said closed position.

18. The refrigerated oven of claim 17, wherein said cooking compartment is removably associated with said housing so as to be removably connected to said refrigerator unit.

19. A cooking system, comprising:

a food item to be cooked; and a refrigerated oven having a refrigerator unit disposed in a housing, a cooking compartment removably associated with said housing and said refrigerator unit, an air flow door disposed between said refrigerator unit and said cooking compartment or associated with one of said refrigerator unit and said cooking compartment, said refrigerator unit having a refrigeration mechanism structured and arranged to discharge cold air from said refrigerator unit, said cooking compartment having an interior chamber sized and configured to removably receive said food item therein and a cooking mechanism structured and arranged to discharge hot air into said interior chamber to cook said food item when said food item is disposed in said interior chamber, said interior chamber disposed in fluid flow communication with said refrigerator unit so as to receive cold air into said interior chamber to cool said food item when said food item is disposed in said interior chamber, said air flow door configured to prevent air flow between said refrigerator unit and said interior department when said air flow door is in a closed position and to allow air flow between said refrigerator unit and said interior department when said air flow door is in an open position, said cooking compartment sized and configured to be removably received in a passageway defined by said housing between said refrigerator unit and a passageway opening at one of said walls of said housing when connecting said removable cooking compartment to said refrigerator unit, wherein said food item is kept cold when positioned in said interior chamber with said air flow door in said open position and is cooked by said cooking mechanism with said air flow door in said closed position.

20. The system of claim 19 further comprising a barrier moveably associated with said housing at or near said passageway opening to selectively close said passageway so as to prevent cold air from exiting said housing when said removable cooking compartment is not in said passageway.

* * * * *